US011122953B2

(12) United States Patent
Zita et al.

(10) Patent No.: US 11,122,953 B2
(45) Date of Patent: Sep. 21, 2021

(54) ROBOTIC CLEANING DEVICE

(71) Applicant: Aktiebolaget Electrolux, Stockholm (SE)

(72) Inventors: Johann Zita, Stockholm (SE); Magnus Wennerström, Stockholm (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 494 days.

(21) Appl. No.: 16/099,782

(22) PCT Filed: May 11, 2016

(86) PCT No.: PCT/EP2016/060571
§ 371 (c)(1),
(2) Date: Nov. 8, 2018

(87) PCT Pub. No.: WO2017/194102
PCT Pub. Date: Nov. 16, 2017

(65) Prior Publication Data

US 2019/0133401 A1 May 9, 2019

(51) Int. Cl.
*A47L 11/40* (2006.01)
*A47L 9/00* (2006.01)

(52) U.S. Cl.
CPC ..... *A47L 11/4058* (2013.01); *A47L 9/009* (2013.01); *A47L 11/4061* (2013.01); *A47L 11/4063* (2013.01); *A47L 2201/04* (2013.01)

(58) Field of Classification Search
CPC .. A47L 11/4058; A47L 9/009; A47L 11/4061; A47L 11/4063; A47L 2201/04
See application file for complete search history.

(56) References Cited

U.S. PATENT DOCUMENTS 1,286,321 A 12/1918 Hoover
1,401,007 A 12/1921 Staples
(Continued)

FOREIGN PATENT DOCUMENTS

CA 2154758 6/1995
CN 1116818 2/1996
(Continued)

OTHER PUBLICATIONS

Internatinal Search Report and Written Opinion of the International Searching Authority for International Application No. PCT/E2016/072291, dated Jun. 6, 2017, 11 pages.
(Continued)

*Primary Examiner* — David Redding
(74) *Attorney, Agent, or Firm* — RatnerPrestia

(57) ABSTRACT

A robotic cleaning device having a main body, at least one drive wheel, at least one linking member rotationally coupled to the main body about a suspension axis and rotationally supporting the at least one drive wheel about a drive wheel axis such that at least a section of the main body can be raised from a lowered position, closer to the ground surface, to a raised position, further away from the ground surface. First and second spring members are arranged to provide a moment on the linking member about the suspension axis in the first direction to press the at least one drive wheel towards the ground surface. The moment provided by the first spring member is higher in the lowered position than in the raised position and the moment provided by the second spring member is higher in the raised position than in the lowered position.

14 Claims, 4 Drawing Sheets

(56) References Cited

U.S. PATENT DOCUMENTS

| | | | |
|---|---|---|---|
| 3,010,129 | A | 11/1961 | Moore |
| 3,233,274 | A | 2/1966 | Kroll |
| 3,550,714 | A | 12/1970 | Bellinger |
| 3,570,227 | A | 3/1971 | Bellinger |
| 3,713,505 | A | 1/1973 | Muller |
| 3,837,028 | A | 9/1974 | Bridge |
| 4,028,765 | A | 6/1977 | Liebscher |
| 4,036,147 | A | 7/1977 | Westling |
| 4,114,711 | A | 9/1978 | Wilkins |
| 4,119,900 | A | 10/1978 | Kremnitz |
| 4,306,174 | A | 12/1981 | Mourier |
| 4,306,329 | A | 12/1981 | Yokoi |
| 4,369,543 | A | 1/1983 | Chen |
| 4,502,173 | A | 3/1985 | Patzold |
| 4,627,511 | A | 12/1986 | Yajima |
| 4,647,209 | A | 3/1987 | Neukomm |
| 4,800,978 | A | 1/1989 | Wasa |
| 4,822,450 | A | 4/1989 | Davis |
| 4,825,091 | A | 4/1989 | Breyer |
| 4,836,905 | A | 6/1989 | Davis |
| 4,838,990 | A | 6/1989 | Jucha |
| 4,842,686 | A | 6/1989 | Davis |
| 4,849,067 | A | 7/1989 | Jucha |
| 4,854,000 | A | 8/1989 | Takimoto |
| 4,864,511 | A | 9/1989 | Moy |
| 4,872,938 | A | 10/1989 | Davis |
| 4,878,003 | A | 10/1989 | Knepper |
| 4,886,570 | A | 12/1989 | Davis |
| 4,918,607 | A | 4/1990 | Wible |
| 4,919,224 | A | 4/1990 | Shyu |
| 4,922,559 | A | 5/1990 | Wall |
| 4,959,192 | A | 9/1990 | Trundle |
| 4,962,453 | A | 10/1990 | Pong |
| 4,989,818 | A | 2/1991 | Trundle |
| 5,001,635 | A | 3/1991 | Yasutomi |
| 5,006,302 | A | 4/1991 | Trundle |
| 5,023,444 | A | 6/1991 | Ohman |
| 5,032,775 | A | 7/1991 | Mizuno |
| 5,034,673 | A | 7/1991 | Shoji |
| 5,042,861 | A | 8/1991 | Trundle |
| 5,045,118 | A | 9/1991 | Mason |
| 5,086,535 | A | 2/1992 | Grossmeyer |
| 5,095,577 | A | 3/1992 | Jonas |
| 5,107,946 | A | 4/1992 | Kamimura |
| 5,155,683 | A | 10/1992 | Rahim |
| 5,243,732 | A | 9/1993 | Koharagi |
| 5,245,177 | A | 9/1993 | Schiller |
| 5,276,933 | A | 1/1994 | Hennessey |
| 5,279,672 | A | 1/1994 | Betker |
| 5,293,955 | A | 3/1994 | Lee |
| 5,307,273 | A | 4/1994 | Oh |
| 5,309,592 | A | 5/1994 | Hiratsuka |
| 5,341,540 | A | 8/1994 | Soupert |
| 5,345,639 | A | 9/1994 | Tanoue |
| 5,349,378 | A | 9/1994 | Maali |
| 5,353,224 | A | 10/1994 | Lee |
| 5,367,458 | A | 11/1994 | Roberts |
| 5,369,347 | A | 11/1994 | Yoo |
| 5,377,106 | A | 12/1994 | Drunk |
| 5,390,627 | A | 2/1995 | van der Berg |
| 5,398,632 | A | 3/1995 | Goldbach |
| 5,402,051 | A | 3/1995 | Fujiwara |
| 5,440,216 | A | 8/1995 | Kim |
| 5,444,965 | A | 8/1995 | Colens |
| 5,446,356 | A | 8/1995 | Kim |
| 5,454,129 | A | 10/1995 | Kell |
| 5,518,552 | A | 5/1996 | Tanoue |
| 5,534,762 | A | 7/1996 | Kim |
| 5,548,511 | A | 8/1996 | Bancroft |
| 5,560,077 | A | 10/1996 | Crotchett |
| 5,568,589 | A | 10/1996 | Hwang |
| 5,621,291 | A | 4/1997 | Lee |
| 5,646,494 | A | 7/1997 | Han |
| 5,666,689 | A | 9/1997 | Andersen |
| 5,682,313 | A | 10/1997 | Edlund |
| 5,682,640 | A | 11/1997 | Han |
| 5,687,294 | A | 11/1997 | Jeong |
| 5,698,957 | A | 12/1997 | Sowada |
| 5,745,946 | A | 5/1998 | Thrasher |
| 5,758,298 | A | 5/1998 | Guldner |
| 5,778,554 | A | 7/1998 | Jones |
| 5,781,960 | A | 7/1998 | Kilstrom |
| 5,787,545 | A | 8/1998 | Colens |
| 5,815,880 | A | 10/1998 | Nakanishi |
| 5,825,981 | A | 10/1998 | Matsuda |
| 5,841,259 | A | 11/1998 | Kim |
| 5,852,984 | A | 12/1998 | Matsuyama |
| 5,867,800 | A | 2/1999 | Leif |
| 5,890,250 | A | 4/1999 | Lange |
| 5,896,488 | A | 4/1999 | Jeong |
| 5,903,124 | A | 5/1999 | Kawakami |
| 5,926,909 | A | 7/1999 | McGee |
| 5,933,902 | A | 8/1999 | Frey |
| 5,935,179 | A | 8/1999 | Kleiner |
| 5,940,927 | A | 8/1999 | Haegermarck |
| 5,942,869 | A | 8/1999 | Katou |
| 5,947,051 | A | 9/1999 | Geiger |
| 5,959,423 | A | 9/1999 | Nakanishi |
| 5,959,424 | A | 9/1999 | Elkmann |
| 5,966,765 | A | 10/1999 | Hamada |
| RE36,391 | E | 11/1999 | vandenBerg |
| 5,983,833 | A | 11/1999 | van der Lely |
| 5,987,696 | A | 11/1999 | Wang |
| 5,991,951 | A | 11/1999 | Kubo |
| 5,995,884 | A | 11/1999 | Allen |
| 5,997,670 | A | 12/1999 | Walter |
| 5,999,865 | A | 12/1999 | Bloomquist |
| 6,012,470 | A | 1/2000 | Jones |
| 6,024,107 | A | 2/2000 | Jones |
| 6,064,926 | A | 5/2000 | Sarangapani |
| 6,076,662 | A | 6/2000 | Bahten |
| 6,082,377 | A | 7/2000 | Frey |
| 6,124,694 | A | 9/2000 | Bancroft |
| 6,142,252 | A | 11/2000 | Kinto |
| 6,176,067 | B1 | 1/2001 | Bahten |
| 6,213,136 | B1 | 4/2001 | Jones |
| 6,226,830 | B1 | 5/2001 | Hendriks |
| 6,230,360 | B1 | 5/2001 | Singleton |
| 6,251,551 | B1 | 6/2001 | Kunze-Concewitz |
| 6,255,793 | B1 | 7/2001 | Peless |
| 6,263,989 | B1 | 7/2001 | Won |
| 6,300,737 | B1 | 10/2001 | Bergvall |
| 6,311,366 | B1 | 11/2001 | Sepke et al. |
| 6,327,741 | B1 | 12/2001 | Reed |
| 6,339,735 | B1 | 1/2002 | Peless |
| 6,358,325 | B1 | 3/2002 | Andreas |
| 6,360,801 | B1 | 3/2002 | Walter |
| 6,370,452 | B1 | 4/2002 | Pfister |
| 6,370,453 | B2 | 4/2002 | Sommer |
| 6,381,801 | B1 | 5/2002 | Clemons, Sr. |
| 6,389,329 | B1 | 5/2002 | Colens |
| 6,413,149 | B1 | 7/2002 | Wada |
| 6,417,641 | B2 | 7/2002 | Peless |
| 6,431,296 | B1 | 8/2002 | Won |
| 6,438,456 | B1 | 8/2002 | Feddema |
| 6,443,509 | B1 | 9/2002 | Levin |
| 6,457,199 | B1 | 10/2002 | Frost |
| 6,457,206 | B1 | 10/2002 | Judson |
| 6,459,955 | B1 | 10/2002 | Bartsch |
| 6,465,982 | B1 | 10/2002 | Bergvall |
| 6,481,515 | B1 | 11/2002 | Kirkpatrick |
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |

(56) References Cited

U.S. PATENT DOCUMENTS

| | | | |
|---|---|---|---|
| 6,594,844 | B2 | 7/2003 | Jones |
| 6,597,143 | B2 | 7/2003 | Song |
| 6,601,265 | B1 | 8/2003 | Burlington |
| 6,605,156 | B1 | 8/2003 | Clark |
| 6,609,962 | B1 | 8/2003 | Wakabayashi |
| 6,611,120 | B2 | 8/2003 | Song |
| 6,611,318 | B2 | 8/2003 | LaPolice |
| 6,615,108 | B1 | 9/2003 | Peless |
| 6,615,885 | B1 | 9/2003 | Ohm |
| 6,633,150 | B1 | 10/2003 | Wallach |
| 6,637,446 | B2 | 10/2003 | Frost |
| 6,658,325 | B2 | 12/2003 | Zweig |
| 6,661,239 | B1 | 12/2003 | Ozick |
| 6,662,889 | B2 | 12/2003 | De Fazio |
| 6,667,592 | B2 | 12/2003 | Jacobs |
| 6,668,951 | B2 | 12/2003 | Won |
| 6,671,592 | B1 | 12/2003 | Bisset |
| 6,690,134 | B1 | 2/2004 | Jones |
| 6,726,823 | B1 | 4/2004 | Wang |
| 6,732,826 | B2 | 5/2004 | Song |
| 6,745,431 | B2 | 6/2004 | Dijksman |
| 6,748,297 | B2 | 6/2004 | Song |
| 6,769,004 | B2 | 7/2004 | Barrett |
| 6,774,596 | B1 | 8/2004 | Bisset |
| 6,775,871 | B1 | 8/2004 | Finch |
| 6,781,338 | B2 | 8/2004 | Jones |
| 6,809,490 | B2 | 10/2004 | Jones |
| 6,810,305 | B2 | 10/2004 | Kirkpatrick, Jr. |
| 6,820,801 | B2 | 11/2004 | Kaneko |
| 6,841,963 | B2 | 1/2005 | Song |
| 6,845,297 | B2 | 1/2005 | Allard |
| 6,850,024 | B2 | 2/2005 | Peless |
| 6,859,010 | B2 | 2/2005 | Jeon |
| 6,859,976 | B2 | 3/2005 | Plankenhorn |
| 6,860,206 | B1 | 3/2005 | Rudakevych |
| 6,868,307 | B2 | 3/2005 | Song |
| 6,869,633 | B2 | 3/2005 | Sus |
| 6,870,792 | B2 | 3/2005 | Chiappetta |
| 6,882,334 | B1 | 4/2005 | Meyer |
| 6,883,201 | B2 | 4/2005 | Jones |
| 6,885,912 | B2 | 4/2005 | Peless |
| 6,901,624 | B2 | 6/2005 | Mori |
| 6,925,679 | B2 | 8/2005 | Wallach |
| D510,066 | S | 9/2005 | Hickey |
| 6,938,298 | B2 | 9/2005 | Aasen |
| 6,939,208 | B2 | 9/2005 | Kamimura |
| 6,940,291 | B1 | 9/2005 | Ozick |
| 6,941,199 | B1 | 9/2005 | Bottomley |
| 6,942,548 | B2 | 9/2005 | Wada |
| 6,956,348 | B2 | 10/2005 | Landry |
| 6,957,712 | B2 | 10/2005 | Song |
| 6,964,312 | B2 | 11/2005 | Maggio |
| 6,965,209 | B2 | 11/2005 | Jones |
| 6,967,275 | B2 | 11/2005 | Ozick |
| 6,971,140 | B2 | 12/2005 | Kim |
| 6,971,141 | B1 | 12/2005 | Tak |
| 6,984,952 | B2 | 1/2006 | Peless |
| 7,000,623 | B2 | 2/2006 | Welsh |
| 7,004,269 | B2 | 2/2006 | Song |
| 7,013,200 | B2 | 3/2006 | Wakui |
| 7,013,527 | B2 | 3/2006 | Thomas |
| 7,015,831 | B2 | 3/2006 | Karlsson |
| 7,024,278 | B2 | 4/2006 | Chiappetta |
| 7,031,805 | B2 | 4/2006 | Lee |
| 7,040,968 | B2 | 5/2006 | Kamimura |
| 7,042,342 | B2 | 5/2006 | Luo |
| 7,043,794 | B2 | 5/2006 | Conner |
| 7,050,926 | B2 | 5/2006 | Theurer |
| 7,053,578 | B2 | 5/2006 | Diehl |
| 7,053,580 | B2 | 5/2006 | Aldred |
| 7,054,716 | B2 | 5/2006 | McKee |
| 7,059,012 | B2 | 6/2006 | Song |
| 7,079,923 | B2 | 7/2006 | Abramson |
| 7,082,350 | B2 | 7/2006 | Skoog |
| D526,753 | S | 8/2006 | Tani |
| 7,085,624 | B2 | 8/2006 | Aldred |
| 7,103,449 | B2 | 9/2006 | Woo |
| 7,113,847 | B2 | 9/2006 | Chmura |
| 7,117,067 | B2 | 10/2006 | McLurkin |
| 7,133,745 | B2 | 11/2006 | Wang |
| 7,134,164 | B2 | 11/2006 | Alton |
| 7,135,992 | B2 | 11/2006 | Karlsson |
| 7,143,696 | B2 | 12/2006 | Rudakevych |
| 7,145,478 | B2 | 12/2006 | Goncalves |
| 7,150,068 | B1 | 12/2006 | Ragner |
| 7,155,308 | B2 | 12/2006 | Jones |
| 7,155,309 | B2 | 12/2006 | Peless |
| 7,162,338 | B2 | 1/2007 | Goncalves |
| 7,167,775 | B2 | 1/2007 | Abramson |
| 7,173,391 | B2 | 2/2007 | Jones |
| 7,174,238 | B1 | 2/2007 | Zweig |
| 7,177,737 | B2 | 2/2007 | Karlsson |
| 7,184,586 | B2 | 2/2007 | Jeon |
| 7,185,396 | B2 | 3/2007 | Im |
| 7,185,397 | B2 | 3/2007 | Stuchlik |
| 7,188,000 | B2 | 3/2007 | Chiappetta |
| 7,196,487 | B2 | 3/2007 | Jones |
| 7,199,711 | B2 | 4/2007 | Field |
| 7,200,892 | B2 | 4/2007 | Kim |
| 7,202,630 | B2 | 4/2007 | Dan |
| 7,206,677 | B2 | 4/2007 | Hulden |
| 7,207,081 | B2 | 4/2007 | Gerber |
| 7,208,892 | B2 | 4/2007 | Tondra |
| 7,213,298 | B2 | 5/2007 | Cipolla |
| 7,213,663 | B2 | 5/2007 | Kim |
| 7,222,390 | B2 | 5/2007 | Cipolla |
| 7,225,500 | B2 | 6/2007 | Diehl |
| 7,237,298 | B2 | 7/2007 | Reindle |
| 7,240,396 | B2 | 7/2007 | Thomas, Sr. |
| 7,246,405 | B2 | 7/2007 | Yan |
| 7,248,951 | B2 | 7/2007 | Hulden |
| 7,251,853 | B2 | 8/2007 | Park |
| 7,254,464 | B1 | 8/2007 | McLurkin |
| 7,254,859 | B2 | 8/2007 | Gerber |
| 7,269,877 | B2 | 9/2007 | Tondra |
| 7,272,467 | B2 | 9/2007 | Goncalves |
| 7,272,868 | B2 | 9/2007 | Im |
| 7,274,167 | B2 | 9/2007 | Kim |
| 7,275,280 | B2 | 10/2007 | Haegermarck |
| 7,288,912 | B2 | 10/2007 | Landry |
| D556,961 | S | 12/2007 | Swyst |
| 7,303,776 | B2 | 12/2007 | Sus |
| 7,324,870 | B2 | 1/2008 | Lee |
| 7,331,436 | B1 | 2/2008 | Pack |
| 7,332,890 | B2 | 2/2008 | Cohen |
| 7,343,221 | B2 | 3/2008 | Ann |
| 7,343,719 | B2 | 3/2008 | Sus |
| 7,346,428 | B1 | 3/2008 | Huffman |
| 7,349,759 | B2 | 3/2008 | Peless |
| 7,359,766 | B2 | 4/2008 | Jeon |
| 7,363,994 | B1 | 4/2008 | DeFazio |
| 7,369,460 | B2 | 5/2008 | Chiappetta |
| 7,372,004 | B2 | 5/2008 | Buchner |
| 7,388,343 | B2 | 6/2008 | Jones |
| 7,389,156 | B2 | 6/2008 | Ziegler |
| 7,389,166 | B2 | 6/2008 | Harwig |
| 7,403,360 | B2 | 7/2008 | Cunningham |
| 7,412,748 | B2 | 8/2008 | Lee |
| 7,417,404 | B2 | 8/2008 | Lee |
| 7,418,762 | B2 | 9/2008 | Arai |
| 7,424,766 | B2 | 9/2008 | Reindle |
| 7,429,843 | B2 | 9/2008 | Jones |
| 7,430,455 | B2 | 9/2008 | Casey |
| 7,438,766 | B2 | 10/2008 | Song |
| 7,441,298 | B2 | 10/2008 | Svendsen |
| 7,444,206 | B2 | 10/2008 | Abramson |
| 7,448,113 | B2 | 11/2008 | Jones |
| 7,459,871 | B2 | 12/2008 | Landry |
| 7,464,157 | B2 | 12/2008 | Okude |
| 7,474,941 | B2 | 1/2009 | Kim |
| 7,480,958 | B2 | 1/2009 | Song |
| 7,480,960 | B2 | 1/2009 | Kim |
| D586,959 | S | 2/2009 | Geringer |
| 7,489,277 | B2 | 2/2009 | Sung |

(56) References Cited

U.S. PATENT DOCUMENTS

| | | | |
|---|---|---|---|
| 7,489,985 | B2 | 2/2009 | Ko |
| 7,499,774 | B2 | 3/2009 | Barrett |
| 7,499,775 | B2 | 3/2009 | Filippov |
| 7,499,776 | B2 | 3/2009 | Allard |
| 7,499,804 | B2 | 3/2009 | Svendsen |
| 7,503,096 | B2 | 3/2009 | Lin |
| 7,515,991 | B2 | 4/2009 | Egawa |
| D593,265 | S | 5/2009 | Carr |
| 7,539,557 | B2 | 5/2009 | Yamauchi |
| 7,546,891 | B2 | 6/2009 | Won |
| 7,546,912 | B1 | 6/2009 | Pack |
| 7,555,363 | B2 | 6/2009 | Augenbraun |
| 7,556,108 | B2 | 7/2009 | Won |
| 7,559,269 | B2 | 7/2009 | Rudakevych |
| 7,564,571 | B2 | 7/2009 | Karabassi |
| 7,566,839 | B2 | 7/2009 | Hukuba |
| 7,567,052 | B2 | 7/2009 | Jones |
| 7,568,259 | B2 | 8/2009 | Yan |
| 7,568,536 | B2 | 8/2009 | Yu |
| 7,571,511 | B2 | 8/2009 | Jones |
| 7,573,403 | B2 | 8/2009 | Goncalves |
| 7,574,282 | B2 | 8/2009 | Petersson |
| 7,578,020 | B2 | 8/2009 | Jaworski |
| 7,579,803 | B2 | 8/2009 | Jones |
| 7,581,282 | B2 | 9/2009 | Woo |
| 7,597,162 | B2 | 10/2009 | Won |
| 7,600,521 | B2 | 10/2009 | Woo |
| 7,600,593 | B2 | 10/2009 | Filippov |
| 7,603,744 | B2 | 10/2009 | Reindle |
| 7,604,675 | B2 | 10/2009 | Makarov |
| 7,610,651 | B2 | 11/2009 | Baek |
| 7,613,543 | B2 | 11/2009 | Petersson |
| 7,620,476 | B2 | 11/2009 | Morse |
| 7,636,982 | B2 | 12/2009 | Jones |
| 7,647,144 | B2 | 1/2010 | Haegermarck |
| 7,650,666 | B2 | 1/2010 | Jang |
| 7,654,348 | B2 | 2/2010 | Ohm |
| 7,660,650 | B2 | 2/2010 | Kawagoe |
| 7,663,333 | B2 | 2/2010 | Jones |
| 7,673,367 | B2 | 3/2010 | Kim |
| 7,679,532 | B2 | 3/2010 | Karlsson |
| 7,688,676 | B2 | 3/2010 | Chiappetta |
| 7,693,654 | B1 | 4/2010 | Dietsch |
| 7,697,141 | B2 | 4/2010 | Jones |
| 7,706,917 | B1 | 4/2010 | Chiappetta |
| 7,706,921 | B2 | 4/2010 | Jung |
| 7,709,497 | B2 | 5/2010 | Christensen, IV |
| 7,711,450 | B2 | 5/2010 | Im |
| 7,720,572 | B2 | 5/2010 | Ziegler |
| 7,721,829 | B2 | 5/2010 | Lee |
| 7,729,801 | B2 | 6/2010 | Abramson |
| 7,749,294 | B2 | 7/2010 | Oh |
| 7,751,940 | B2 | 7/2010 | Lee |
| 7,761,954 | B2 | 7/2010 | Ziegler |
| 7,765,635 | B2 | 8/2010 | Park |
| 7,765,638 | B2 | 8/2010 | Pineschi |
| 7,769,490 | B2 | 8/2010 | Abramson |
| 7,774,158 | B2 | 8/2010 | Domingues Goncalves |
| 7,779,504 | B2 | 8/2010 | Lee |
| 7,780,796 | B2 | 8/2010 | Shim |
| 7,784,139 | B2 | 8/2010 | Sawalski |
| 7,784,570 | B2 | 8/2010 | Couture |
| 7,785,544 | B2 | 8/2010 | Alward |
| 7,787,991 | B2 | 8/2010 | Jeung |
| 7,793,614 | B2 | 9/2010 | Ericsson |
| 7,801,645 | B2 | 9/2010 | Taylor |
| 7,805,220 | B2 | 9/2010 | Taylor |
| 7,827,653 | B1 | 11/2010 | Liu |
| 7,832,048 | B2 | 11/2010 | Harwig |
| 7,835,529 | B2 | 11/2010 | Hernandez |
| 7,843,431 | B2 | 11/2010 | Robbins |
| 7,844,364 | B2 | 11/2010 | McLurkin |
| 7,849,555 | B2 | 12/2010 | Hahm |
| 7,856,291 | B2 | 12/2010 | Jung |
| 7,860,608 | B2 | 12/2010 | Lee |
| 7,861,365 | B2 | 1/2011 | Sun |
| 7,861,366 | B2 | 1/2011 | Hahm |
| 7,873,437 | B2 | 1/2011 | Aldred |
| 7,877,166 | B2 | 1/2011 | Harwig |
| 7,886,399 | B2 | 2/2011 | Dayton |
| 7,890,210 | B2 | 2/2011 | Choi |
| 7,891,045 | B2 | 2/2011 | Kim |
| 7,891,289 | B2 | 2/2011 | Day |
| 7,891,446 | B2 | 2/2011 | Couture |
| 7,894,951 | B2 | 2/2011 | Norris |
| 7,916,931 | B2 | 3/2011 | Lee |
| 7,920,941 | B2 | 4/2011 | Park |
| 7,921,506 | B2 | 4/2011 | Baek |
| 7,926,598 | B2 | 4/2011 | Rudakevych |
| 7,934,571 | B2 | 5/2011 | Chiu |
| 7,937,800 | B2 | 5/2011 | Yan |
| 7,942,107 | B2 | 5/2011 | Vosburgh |
| 7,957,837 | B2 | 6/2011 | Ziegler |
| 7,962,997 | B2 | 6/2011 | Chung |
| 7,966,339 | B2 | 6/2011 | Kim |
| 7,975,790 | B2 | 7/2011 | Kim |
| 7,979,175 | B2 | 7/2011 | Allard |
| 7,979,945 | B2 | 7/2011 | Dayton |
| 7,981,455 | B2 | 7/2011 | Sus |
| 7,997,118 | B2 | 8/2011 | Mecca |
| 8,001,651 | B2 | 8/2011 | Chang |
| 8,007,221 | B1 | 8/2011 | More |
| 8,010,229 | B2 | 8/2011 | Kim |
| 8,019,223 | B2 | 9/2011 | Hudson |
| 8,020,657 | B2 | 9/2011 | Allard |
| 8,032,978 | B2 | 10/2011 | Haegermarck |
| 8,034,390 | B2 | 10/2011 | Sus |
| 8,042,663 | B1 | 10/2011 | Pack |
| 8,046,103 | B2 | 10/2011 | Abramson |
| 8,061,461 | B2 | 11/2011 | Couture |
| 8,065,778 | B2 | 11/2011 | Kim |
| 8,073,439 | B2 | 12/2011 | Stromberg |
| 8,074,752 | B2 | 12/2011 | Rudakevych |
| 8,078,338 | B2 | 12/2011 | Pack |
| 8,079,432 | B2 | 12/2011 | Ohm |
| 8,082,836 | B2 | 12/2011 | More |
| 8,086,419 | B2 | 12/2011 | Goncalves |
| 8,087,117 | B2 | 1/2012 | Kapoor |
| 8,095,238 | B2 | 1/2012 | Jones |
| 8,095,336 | B2 | 1/2012 | Goncalves |
| 8,107,318 | B2 | 1/2012 | Chiappetta |
| 8,108,092 | B2 | 1/2012 | Phillips |
| 8,109,191 | B1 | 2/2012 | Rudakevych |
| 8,112,942 | B2 | 2/2012 | Bohm |
| 8,113,304 | B2 | 2/2012 | Won |
| 8,122,982 | B2 | 2/2012 | Morey |
| 8,127,396 | B2 | 3/2012 | Mangiardi |
| 8,127,399 | B2 | 3/2012 | Dilger |
| 8,127,704 | B2 | 3/2012 | Vosburgh |
| 8,136,200 | B2 | 3/2012 | Splinter |
| 8,150,650 | B2 | 4/2012 | Goncalves |
| D659,311 | S | 5/2012 | Geringer |
| 8,166,904 | B2 | 5/2012 | Israel |
| 8,195,333 | B2 | 6/2012 | Ziegler |
| 8,196,251 | B2 | 6/2012 | Lynch |
| 8,199,109 | B2 | 6/2012 | Robbins |
| 8,200,600 | B2 | 6/2012 | Rosenstein |
| 8,200,700 | B2 | 6/2012 | Moore |
| 8,237,389 | B2 | 8/2012 | Fitch |
| 8,237,920 | B2 | 8/2012 | Jones |
| 8,239,992 | B2 | 8/2012 | Schnittman |
| 8,244,469 | B2 | 8/2012 | Cheung |
| 8,253,368 | B2 | 8/2012 | Landry |
| 8,255,092 | B2 | 8/2012 | Phillips |
| 8,256,542 | B2 | 9/2012 | Couture |
| 8,265,793 | B2 | 9/2012 | Cross |
| 8,274,406 | B2 | 9/2012 | Karlsson |
| 8,281,703 | B2 | 10/2012 | Moore |
| 8,281,731 | B2 | 10/2012 | Vosburgh |
| 8,290,619 | B2 | 10/2012 | McLurkin |
| 8,292,007 | B2 | 10/2012 | DeFazio et al. |
| 8,295,125 | B2 | 10/2012 | Chiappetta |
| D670,877 | S | 11/2012 | Geringer |
| 8,308,529 | B2 | 11/2012 | DAmbra et al. |

(56) References Cited

U.S. PATENT DOCUMENTS

| | | | |
|---|---|---|---|
| 8,311,674 | B2 | 11/2012 | Abramson |
| 8,316,971 | B2 | 11/2012 | Couture |
| 8,318,499 | B2 | 11/2012 | Fritchie |
| D672,928 | S | 12/2012 | Swett |
| 8,322,470 | B2 | 12/2012 | Ohm |
| 8,326,469 | B2 | 12/2012 | Phillips |
| 8,327,960 | B2 | 12/2012 | Couture |
| 8,336,479 | B2 | 12/2012 | Vosburgh |
| 8,342,271 | B2 | 1/2013 | Filippov |
| 8,347,088 | B2 | 1/2013 | Moore |
| 8,347,444 | B2 | 1/2013 | Schnittman |
| 8,350,810 | B2 | 1/2013 | Robbins |
| 8,353,373 | B2 | 1/2013 | Rudakevych |
| 8,364,309 | B1 | 1/2013 | Bailey |
| 8,364,310 | B2 | 1/2013 | Jones |
| 8,365,848 | B2 | 2/2013 | Won |
| 8,368,339 | B2 | 2/2013 | Jones |
| 8,370,985 | B2 | 2/2013 | Schnittman |
| 8,374,721 | B2 | 2/2013 | Halloran |
| 8,375,838 | B2 | 2/2013 | Rudakevych |
| 8,378,613 | B2 | 2/2013 | Landry |
| 8,380,350 | B2 | 2/2013 | Ozick |
| 8,382,906 | B2 | 2/2013 | Konandreas |
| 8,386,081 | B2 | 2/2013 | Landry |
| 8,387,193 | B2 | 3/2013 | Ziegler |
| 8,390,251 | B2 | 3/2013 | Cohen |
| 8,392,021 | B2 | 3/2013 | Konandreas |
| 8,396,592 | B2 | 3/2013 | Jones |
| 8,396,611 | B2 | 3/2013 | Phillips |
| 8,402,586 | B2 | 3/2013 | Lavabre |
| 8,408,956 | B1 | 4/2013 | Vosburgh |
| 8,412,377 | B2 | 4/2013 | Casey |
| 8,413,752 | B2 | 4/2013 | Page |
| 8,417,188 | B1 | 4/2013 | Vosburgh |
| 8,417,383 | B2 | 4/2013 | Ozick |
| 8,418,303 | B2 | 4/2013 | Kapoor |
| 8,418,642 | B2 | 4/2013 | Vosburgh |
| 8,428,778 | B2 | 4/2013 | Landry |
| 8,433,442 | B2 | 4/2013 | Friedman |
| D682,362 | S | 5/2013 | Mozeika |
| 8,438,694 | B2 | 5/2013 | Kim |
| 8,438,695 | B2 | 5/2013 | Gilbert, Jr. |
| 8,438,698 | B2 | 5/2013 | Kim |
| 8,447,440 | B2 | 5/2013 | Phillips |
| 8,447,613 | B2 | 5/2013 | Hussey |
| 8,452,448 | B2 | 5/2013 | Pack |
| 8,453,289 | B2 | 6/2013 | Lynch |
| 8,456,125 | B2 | 6/2013 | Landry |
| 8,461,803 | B2 | 6/2013 | Cohen |
| 8,463,438 | B2 | 6/2013 | Jones |
| 8,473,140 | B2 | 6/2013 | Norris |
| 8,474,090 | B2 | 7/2013 | Jones |
| 8,478,442 | B2 | 7/2013 | Casey |
| 8,485,330 | B2 | 7/2013 | Pack |
| 8,505,158 | B2 | 8/2013 | Han |
| 8,508,388 | B2 | 8/2013 | Karlsson |
| 8,515,578 | B2 | 8/2013 | Chiappetta |
| 8,516,651 | B2 | 8/2013 | Jones |
| 8,525,995 | B2 | 9/2013 | Jones |
| 8,527,113 | B2 | 9/2013 | Yamauchi |
| 8,528,157 | B2 | 9/2013 | Schnittman |
| 8,528,162 | B2 | 9/2013 | Tang |
| 8,528,673 | B2 | 9/2013 | More |
| 8,532,822 | B2 | 9/2013 | Abramson |
| 8,533,144 | B1 | 9/2013 | Reeser |
| 8,534,983 | B2 | 9/2013 | Schoenfeld |
| 8,543,562 | B2 | 9/2013 | Mule |
| 8,548,626 | B2 | 10/2013 | Steltz |
| 8,551,254 | B2 | 10/2013 | Dayton |
| 8,551,421 | B2 | 10/2013 | Luchinger |
| 8,565,920 | B2 | 10/2013 | Casey |
| 8,572,799 | B2 | 11/2013 | Won |
| 8,584,305 | B2 | 11/2013 | Won |
| 8,584,306 | B2 | 11/2013 | Chung |
| 8,584,307 | B2 | 11/2013 | Won |
| 8,594,840 | B1 | 11/2013 | Chiappetta |
| 8,598,829 | B2 | 12/2013 | Landry |
| 8,599,645 | B2 | 12/2013 | Chiappetta |
| 8,600,553 | B2 | 12/2013 | Svendsen |
| 8,606,401 | B2 | 12/2013 | Ozick |
| 8,634,956 | B1 | 1/2014 | Chiappetta |
| 8,634,958 | B1 | 1/2014 | Chiappetta |
| 8,666,523 | B2 | 3/2014 | Kim |
| 8,671,513 | B2 | 3/2014 | Yoo |
| 8,732,895 | B2 | 5/2014 | Cunningham |
| 8,741,013 | B2 | 6/2014 | Swett |
| 8,743,286 | B2 | 6/2014 | Hasegawa |
| 8,745,194 | B2 | 6/2014 | Uribe-Etxebarria Jimenez |
| 8,755,936 | B2 | 6/2014 | Friedman |
| 8,761,931 | B2 | 6/2014 | Halloran |
| 8,763,200 | B2 | 7/2014 | Kim |
| 8,774,970 | B2 | 7/2014 | Knopow |
| 8,798,791 | B2 | 8/2014 | Li |
| 8,798,792 | B2 | 8/2014 | Park |
| 8,799,258 | B2 | 8/2014 | Mule |
| 8,838,274 | B2 | 9/2014 | Jones |
| 8,839,477 | B2 | 9/2014 | Schnittman |
| 8,843,245 | B2 | 9/2014 | Choe |
| 8,855,914 | B1 | 10/2014 | Alexander |
| 8,874,264 | B1 | 10/2014 | Chiappetta |
| 8,881,339 | B2 | 11/2014 | Gilbert, Jr. |
| 8,924,042 | B2 | 12/2014 | Kim |
| 8,961,695 | B2 | 2/2015 | Romanov |
| 8,985,127 | B2 | 3/2015 | Konandreas |
| 8,996,172 | B2 | 3/2015 | Shah |
| 9,033,079 | B2 | 5/2015 | Shin |
| 9,037,396 | B2 | 5/2015 | Pack |
| 9,144,361 | B2 | 9/2015 | Landry |
| 9,360,300 | B2 | 6/2016 | Dibernado |
| 9,596,971 | B2 | 3/2017 | Yoon |
| 9,687,132 | B2 | 6/2017 | Schlischka |
| 10,045,675 | B2 | 8/2018 | Haegermarck |
| 2001/0004719 | A1 | 6/2001 | Sommer |
| 2001/0037163 | A1 | 11/2001 | Allard |
| 2002/0016649 | A1 | 2/2002 | Jones |
| 2002/0091466 | A1 | 7/2002 | Song |
| 2002/0108635 | A1 | 8/2002 | Marrero |
| 2002/0121288 | A1 | 9/2002 | Marrero |
| 2002/0121561 | A1 | 9/2002 | Marrero |
| 2002/0164932 | A1 | 11/2002 | Kamimura |
| 2002/0174506 | A1 | 11/2002 | Wallach |
| 2002/0185071 | A1 | 12/2002 | Guo |
| 2002/0189871 | A1 | 12/2002 | Won |
| 2003/0000034 | A1 | 1/2003 | Welsh |
| 2003/0025472 | A1 | 2/2003 | Jones |
| 2003/0030398 | A1 | 2/2003 | Jacobs |
| 2003/0120972 | A1 | 6/2003 | Matsushima |
| 2003/0140449 | A1 | 7/2003 | Alton |
| 2003/0159223 | A1 | 8/2003 | Plankenhorn |
| 2003/0167000 | A1 | 9/2003 | Mullick |
| 2003/0229421 | A1 | 12/2003 | Chmura |
| 2004/0020000 | A1 | 2/2004 | Jones |
| 2004/0031111 | A1 | 2/2004 | Porchia |
| 2004/0031121 | A1 | 2/2004 | Martin |
| 2004/0034952 | A1 | 2/2004 | Ho |
| 2004/0049877 | A1 | 3/2004 | Jones |
| 2004/0049878 | A1 | 3/2004 | Thomas |
| 2004/0074038 | A1 | 4/2004 | Im |
| 2004/0074039 | A1 | 4/2004 | Kim |
| 2004/0098167 | A1 | 5/2004 | Yi |
| 2004/0111184 | A1 | 6/2004 | Chiappetta |
| 2004/0111827 | A1 | 6/2004 | Im |
| 2004/0167667 | A1 | 8/2004 | Goncalves |
| 2004/0181896 | A1 | 9/2004 | Egawa |
| 2004/0182839 | A1 | 9/2004 | Denney |
| 2004/0182840 | A1 | 9/2004 | Denney |
| 2004/0185011 | A1 | 9/2004 | Alexander |
| 2004/0187249 | A1 | 9/2004 | Jones |
| 2004/0207355 | A1 | 10/2004 | Jones |
| 2004/0208212 | A1 | 10/2004 | Denney |
| 2004/0210343 | A1 | 10/2004 | Kim |
| 2004/0220707 | A1 | 11/2004 | Pallister |
| 2005/0010331 | A1 | 1/2005 | Taylor |
| 2005/0015912 | A1 | 1/2005 | Kim |

(56) References Cited

U.S. PATENT DOCUMENTS

| | | | |
|---|---|---|---|
| 2005/0015915 | A1 | 1/2005 | Thomas |
| 2005/0028315 | A1 | 2/2005 | Thomas |
| 2005/0028316 | A1 | 2/2005 | Thomas |
| 2005/0042151 | A1 | 2/2005 | Alward |
| 2005/0065662 | A1 | 3/2005 | Reindle |
| 2005/0085947 | A1 | 4/2005 | Aldred |
| 2005/0088643 | A1 | 4/2005 | Anderson |
| 2005/0156562 | A1 | 7/2005 | Cohen |
| 2005/0166354 | A1 | 8/2005 | Uehigashi |
| 2005/0191949 | A1 | 9/2005 | Kamimura |
| 2005/0217061 | A1 | 10/2005 | Reindle |
| 2005/0223514 | A1 | 10/2005 | Stuchlik |
| 2005/0229340 | A1 | 10/2005 | Sawalski |
| 2005/0230166 | A1 | 10/2005 | Petersson |
| 2005/0234611 | A1 | 10/2005 | Uehigashi |
| 2005/0251292 | A1 | 11/2005 | Casey |
| 2005/0251457 | A1 | 11/2005 | Kashiwagi |
| 2005/0251947 | A1 | 11/2005 | Lee |
| 2005/0267629 | A1 | 12/2005 | Petersson |
| 2005/0278888 | A1 | 12/2005 | Reindle |
| 2005/0287038 | A1 | 12/2005 | Dubrovsky |
| 2006/0009879 | A1 | 1/2006 | Lynch |
| 2006/0010799 | A1 | 1/2006 | Bohm |
| 2006/0020369 | A1 | 1/2006 | Taylor |
| 2006/0028306 | A1 | 2/2006 | Hukuba |
| 2006/0032013 | A1 | 2/2006 | Kim |
| 2006/0045981 | A1 | 3/2006 | Tsushi |
| 2006/0076039 | A1 | 4/2006 | Song et al. |
| 2006/0095158 | A1 | 5/2006 | Lee |
| 2006/0136096 | A1 | 6/2006 | Chiappetta |
| 2006/0144834 | A1 | 7/2006 | Denney |
| 2006/0178777 | A1 | 8/2006 | Park |
| 2006/0190133 | A1 | 8/2006 | Konandreas |
| 2006/0190134 | A1 | 8/2006 | Ziegler |
| 2006/0190146 | A1 | 8/2006 | Morse |
| 2006/0195015 | A1 | 8/2006 | Mullick |
| 2006/0200281 | A1 | 9/2006 | Ziegler |
| 2006/0213025 | A1 | 9/2006 | Sawalski |
| 2006/0235570 | A1 | 10/2006 | Jung |
| 2006/0235585 | A1 | 10/2006 | Tanaka |
| 2006/0236492 | A1 | 10/2006 | Sudo |
| 2006/0288519 | A1 | 12/2006 | Jaworski |
| 2006/0293788 | A1 | 12/2006 | Pogodin |
| 2007/0016328 | A1 | 1/2007 | Ziegler |
| 2007/0021867 | A1 | 1/2007 | Woo |
| 2007/0059441 | A1 | 3/2007 | Greer |
| 2007/0061040 | A1 | 3/2007 | Augenbraun |
| 2007/0114975 | A1 | 5/2007 | Cohen |
| 2007/0118248 | A1 | 5/2007 | Lee |
| 2007/0124890 | A1 | 6/2007 | Erko |
| 2007/0143950 | A1 | 6/2007 | Lin |
| 2007/0156286 | A1 | 7/2007 | Yamauchi |
| 2007/0179670 | A1 | 8/2007 | Chiappetta |
| 2007/0189347 | A1 | 8/2007 | Denney |
| 2007/0204426 | A1 | 9/2007 | Nakagawa |
| 2007/0213892 | A1 | 9/2007 | Jones |
| 2007/0214601 | A1 | 9/2007 | Chung |
| 2007/0234492 | A1 | 10/2007 | Svendsen |
| 2007/0244610 | A1 | 10/2007 | Ozick |
| 2007/0266508 | A1 | 11/2007 | Jones |
| 2007/0267230 | A1 | 11/2007 | Won |
| 2007/0267570 | A1 | 11/2007 | Park |
| 2007/0267998 | A1 | 11/2007 | Cohen |
| 2007/0273864 | A1 | 11/2007 | Cho |
| 2007/0276541 | A1 | 11/2007 | Sawasaki |
| 2007/0285041 | A1 | 12/2007 | Jones |
| 2007/0289267 | A1 | 12/2007 | Makarov |
| 2007/0290649 | A1 | 12/2007 | Jones |
| 2008/0000041 | A1 | 1/2008 | Jones |
| 2008/0000042 | A1 | 1/2008 | Jones |
| 2008/0001566 | A1 | 1/2008 | Jones |
| 2008/0007203 | A1 | 1/2008 | Cohen |
| 2008/0009964 | A1 | 1/2008 | Bruemmer |
| 2008/0015738 | A1 | 1/2008 | Casey |
| 2008/0016631 | A1 | 1/2008 | Casey |
| 2008/0037170 | A1 | 2/2008 | Saliba |
| 2008/0039974 | A1 | 2/2008 | Sandin |
| 2008/0047092 | A1 | 2/2008 | Schnittman |
| 2008/0051953 | A1 | 2/2008 | Jones |
| 2008/0007193 | A1 | 3/2008 | Bow |
| 2008/0052846 | A1 | 3/2008 | Kapoor |
| 2008/0058987 | A1 | 3/2008 | Ozick |
| 2008/0063400 | A1 | 3/2008 | Hudson |
| 2008/0065265 | A1 | 3/2008 | Ozick |
| 2008/0077278 | A1 | 3/2008 | Park |
| 2008/0084174 | A1 | 4/2008 | Jones |
| 2008/0086241 | A1 | 4/2008 | Phillips |
| 2008/0091304 | A1 | 4/2008 | Ozick |
| 2008/0091305 | A1 | 4/2008 | Svendsen |
| 2008/0093131 | A1 | 4/2008 | Couture |
| 2008/0098553 | A1 | 5/2008 | Dayton |
| 2008/0105445 | A1 | 5/2008 | Dayton |
| 2008/0109126 | A1 | 5/2008 | Sandin |
| 2008/0121097 | A1 | 5/2008 | Rudakevych |
| 2008/0127445 | A1 | 6/2008 | Konandreas |
| 2008/0127446 | A1 | 6/2008 | Ziegler |
| 2008/0133052 | A1 | 6/2008 | Jones |
| 2008/0134457 | A1 | 6/2008 | Morse |
| 2008/0134458 | A1 | 6/2008 | Ziegler |
| 2008/0140255 | A1 | 6/2008 | Ziegler |
| 2008/0143063 | A1 | 6/2008 | Won |
| 2008/0143064 | A1 | 6/2008 | Won |
| 2008/0143065 | A1 | 6/2008 | DeFazio |
| 2008/0152871 | A1 | 6/2008 | Greer |
| 2008/0155768 | A1 | 7/2008 | Ziegler |
| 2008/0179115 | A1 | 7/2008 | Ohm |
| 2008/0183332 | A1 | 7/2008 | Ohm |
| 2008/0184518 | A1 | 8/2008 | Taylor |
| 2008/0196946 | A1 | 8/2008 | Filippov |
| 2008/0205194 | A1 | 8/2008 | Chiappetta |
| 2008/0209665 | A1 | 9/2008 | Mangiardi |
| 2008/0221729 | A1 | 9/2008 | Lavarec |
| 2008/0223630 | A1 | 9/2008 | Couture |
| 2008/0235897 | A1 | 10/2008 | Kim |
| 2008/0236907 | A1 | 10/2008 | Won |
| 2008/0264456 | A1 | 10/2008 | Lynch |
| 2008/0266254 | A1 | 10/2008 | Robbins |
| 2008/0276407 | A1 | 11/2008 | Schnittman |
| 2008/0276408 | A1 | 11/2008 | Gilbert |
| 2008/0281470 | A1 | 11/2008 | Gilbert |
| 2008/0282494 | A1 | 11/2008 | Won |
| 2008/0294288 | A1 | 11/2008 | Yamauchi |
| 2008/0307590 | A1 | 12/2008 | Jones |
| 2009/0007366 | A1 | 1/2009 | Svendsen |
| 2009/0025155 | A1 | 1/2009 | Nishiyama |
| 2009/0030551 | A1 | 1/2009 | Hein |
| 2009/0037024 | A1 | 2/2009 | Jamieson |
| 2009/0038089 | A1 | 2/2009 | Landry |
| 2009/0044370 | A1 | 2/2009 | Won |
| 2009/0045766 | A1 | 2/2009 | Casey |
| 2009/0055022 | A1 | 2/2009 | Casey |
| 2009/0065271 | A1 | 3/2009 | Won |
| 2009/0070946 | A1 | 3/2009 | Tamada |
| 2009/0078035 | A1 | 3/2009 | Mecca |
| 2009/0107738 | A1 | 4/2009 | Won |
| 2009/0125175 | A1 | 5/2009 | Park |
| 2009/0126143 | A1 | 5/2009 | Haegermarck |
| 2009/0133720 | A1 | 5/2009 | Vandenbogert |
| 2009/0145671 | A1 | 6/2009 | Filippov |
| 2009/0173553 | A1 | 7/2009 | Won |
| 2009/0180668 | A1 | 7/2009 | Jones |
| 2009/0226113 | A1 | 9/2009 | Matsumoto |
| 2009/0232506 | A1 | 9/2009 | Hudson |
| 2009/0241826 | A1 | 10/2009 | Vosburgh |
| 2009/0254217 | A1 | 10/2009 | Pack |
| 2009/0254218 | A1 | 10/2009 | Sandin |
| 2009/0265036 | A1 | 10/2009 | Jamieson |
| 2009/0270015 | A1 | 10/2009 | Dambra |
| 2009/0274602 | A1 | 11/2009 | Alward |
| 2009/0281661 | A1 | 11/2009 | Dooley |
| 2009/0292393 | A1 | 11/2009 | Casey |
| 2009/0292884 | A1 | 11/2009 | Wang |
| 2009/0314318 | A1 | 12/2009 | Chang |
| 2009/0314554 | A1 | 12/2009 | Couture |

(56) References Cited

U.S. PATENT DOCUMENTS

2009/0319083 A1 12/2009 Jones
2010/0001478 A1 1/2010 DeFazio
2010/0011529 A1 1/2010 Won
2010/0037418 A1 2/2010 Hussey
2010/0049364 A1 2/2010 Landry
2010/0049365 A1 2/2010 Jones
2010/0049391 A1 2/2010 Nakano
2010/0054129 A1 3/2010 Kuik
2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung
2010/0173070 A1 7/2010 Niu
2010/0206336 A1 8/2010 Squid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim
2013/0085603 A1 4/2013 Chiappetta
2013/0086760 A1 4/2013 Han
2013/0092190 A1 4/2013 Yoon
2013/0098402 A1 4/2013 Yoon
2013/0103194 A1 4/2013 Jones
2013/0105233 A1 5/2013 Couture
2013/0117952 A1 5/2013 Schnittman
2013/0118524 A1 5/2013 Konandreas
2013/0138337 A1 5/2013 Pack
2013/0145572 A1 6/2013 Schregardus
2013/0152724 A1 6/2013 Mozeika
2013/0160226 A1 6/2013 Lee
2013/0166107 A1 6/2013 Robbins
2013/0174371 A1 7/2013 Jones
2013/0204463 A1 8/2013 Chiappetta
2013/0204465 A1 8/2013 Phillips
2013/0204483 A1 8/2013 Sung
2013/0205520 A1 8/2013 Kapoor
2013/0206170 A1 8/2013 Svendsen
2013/0206177 A1 8/2013 Burlutskiy
2013/0211589 A1 8/2013 Landry
2013/0214498 A1 8/2013 DeFazio
2013/0226344 A1 8/2013 Wong

(56) References Cited

U.S. PATENT DOCUMENTS

| | | | |
|---|---|---|---|
| 2013/0227801 | A1 | 9/2013 | Kim |
| 2013/0227812 | A1 | 9/2013 | Kim |
| 2013/0228198 | A1 | 9/2013 | Hung |
| 2013/0228199 | A1 | 9/2013 | Hung |
| 2013/0231779 | A1 | 9/2013 | Purkayastha |
| 2013/0231819 | A1 | 9/2013 | Hung |
| 2013/0232702 | A1 | 9/2013 | Baek |
| 2013/0239870 | A1 | 9/2013 | Hudson |
| 2013/0241217 | A1 | 9/2013 | Hickey |
| 2013/0253701 | A1 | 9/2013 | Halloran |
| 2013/0256042 | A1 | 10/2013 | Rudakevych |
| 2013/0268118 | A1 | 10/2013 | Grinstead |
| 2013/0269148 | A1 | 10/2013 | Chiu |
| 2013/0273252 | A1 | 10/2013 | Miyamoto |
| 2013/0298350 | A1 | 11/2013 | Schnittman |
| 2013/0310978 | A1 | 11/2013 | Ozick |
| 2013/0325178 | A1 | 12/2013 | Jones |
| 2013/0331987 | A1 | 12/2013 | Karlsson |
| 2013/0338525 | A1 | 12/2013 | Allen |
| 2013/0338828 | A1 | 12/2013 | Chiappetta |
| 2013/0338831 | A1 | 12/2013 | Noh |
| 2013/0340201 | A1 | 12/2013 | Jang |
| 2014/0016469 | A1 | 1/2014 | Ho |
| 2014/0026338 | A1 | 1/2014 | Kim |
| 2014/0026339 | A1 | 1/2014 | Konandreas |
| 2014/0053351 | A1 | 2/2014 | Kapoor |
| 2014/0109339 | A1 | 4/2014 | Won |
| 2014/0123325 | A1 | 5/2014 | Jung |
| 2014/0130272 | A1 | 5/2014 | Won |
| 2014/0142757 | A1 | 5/2014 | Ziegler |
| 2014/0167931 | A1 | 6/2014 | Lee |
| 2014/0180968 | A1 | 6/2014 | Song |
| 2014/0207280 | A1 | 7/2014 | Duffley |
| 2014/0207281 | A1 | 7/2014 | Angle |
| 2014/0207282 | A1 | 7/2014 | Angle |
| 2014/0238440 | A1 | 8/2014 | Dayton |
| 2014/0249671 | A1 | 9/2014 | Halloran |
| 2014/0283326 | A1 | 9/2014 | Song |
| 2015/0005937 | A1 | 1/2015 | Ponulak |
| 2015/0032259 | A1 | 1/2015 | Kim |
| 2015/0039127 | A1 | 2/2015 | Matsumoto |
| 2015/0057800 | A1 | 2/2015 | Cohen |
| 2015/0120056 | A1 | 4/2015 | Noh |
| 2015/0185322 | A1 | 7/2015 | Haegermarck |
| 2015/0197012 | A1 | 7/2015 | Schnittman |
| 2015/0206015 | A1 | 7/2015 | Ramalingam |
| 2015/0265122 | A1 | 9/2015 | Han |
| 2016/0202703 | A1 | 7/2016 | Matsubara |
| 2016/0306359 | A1 | 10/2016 | Lindhe |
| 2016/0316982 | A1 | 11/2016 | Kim |
| 2017/0273521 | A1 | 9/2017 | Klintemyr |
| 2017/0273524 | A1 | 9/2017 | Klintemyr |
| 2018/0103812 | A1 | 4/2018 | Lee |

FOREIGN PATENT DOCUMENTS

| | | |
|---|---|---|
| CN | 1668238 | 9/2005 |
| CN | 101161174 | 4/2008 |
| CN | 101297267 | 10/2008 |
| CN | 102083352 | 6/2011 |
| CN | 103027634 | 4/2013 |
| CN | 103054516 | 4/2013 |
| CN | 103491838 | 1/2014 |
| CN | 103565373 | 2/2014 |
| DE | 3536907 | 4/1986 |
| DE | 9307500 | 7/1993 |
| DE | 4211789 | 10/1993 |
| DE | 4340367 | 6/1995 |
| DE | 4439427 | 5/1996 |
| DE | 19849978 | 5/2000 |
| DE | 202008017137 | 3/2009 |
| DE | 102010000174 | 7/2011 |
| DE | 102010000573 | 9/2011 |
| DE | 102010037672 | 3/2012 |
| EP | 0142594 | 5/1985 |
| EP | 0358628 | 3/1990 |
| EP | 0474542 | 3/1992 |
| EP | 0569984 | 11/1993 |
| EP | 0606173 | 7/1994 |
| EP | 1099143 | 11/2003 |
| EP | 1360922 | 11/2003 |
| EP | 1441271 | 7/2004 |
| EP | 1331537 | 8/2005 |
| EP | 2050380 | 4/2009 |
| EP | 1969438 | 9/2009 |
| EP | 1395888 | 5/2011 |
| EP | 2316322 | 5/2011 |
| EP | 2296005 | 6/2011 |
| EP | 2251757 | 11/2011 |
| EP | 2417894 | 2/2012 |
| EP | 2438843 | 4/2012 |
| EP | 2466411 | 6/2012 |
| EP | 2561787 | 2/2013 |
| EP | 2578125 | 4/2013 |
| EP | 2583609 | 4/2013 |
| EP | 2604163 | 6/2013 |
| EP | 2447800 | 4/2014 |
| EP | 2741483 | 6/2014 |
| EP | 2772815 | 9/2014 |
| EP | 2992803 | 3/2016 |
| FR | 2999410 | 6/2014 |
| GB | 1447943 | 9/1976 |
| GB | 2355523 | 4/2001 |
| GB | 2382251 | 5/2003 |
| GB | 2494446 | 3/2013 |
| GB | 2884364 | 6/2015 |
| JP | 5540959 | 3/1980 |
| JP | 6286414 | 4/1987 |
| JP | 62109528 | 5/1987 |
| JP | 62120510 | 6/1987 |
| JP | 62152421 | 7/1987 |
| JP | 62152424 | 7/1987 |
| JP | 63127310 | 5/1988 |
| JP | 63181727 | 7/1988 |
| JP | 63241610 | 10/1988 |
| JP | 03162814 | 7/1991 |
| JP | 03166074 | 7/1991 |
| JP | 04260905 | 9/1992 |
| JP | 0584200 | 4/1993 |
| JP | 0584210 | 4/1993 |
| JP | 05084200 | 4/1993 |
| JP | 05189041 | 7/1993 |
| JP | 05224745 | 9/1993 |
| JP | 05228090 | 9/1993 |
| JP | 064133 | 1/1994 |
| JP | 0683442 | 3/1994 |
| JP | 06125861 | 5/1994 |
| JP | 06144215 | 5/1994 |
| JP | 06179145 | 6/1994 |
| JP | 075922 | 1/1995 |
| JP | 0759695 | 3/1995 |
| JP | 0732752 | 4/1995 |
| JP | 07129239 | 5/1995 |
| JP | 07281742 | 10/1995 |
| JP | 08089455 | 4/1996 |
| JP | 08326025 | 12/1996 |
| JP | 0944240 | 2/1997 |
| JP | 09150741 | 6/1997 |
| JP | 09185410 | 7/1997 |
| JP | 11267074 | 10/1999 |
| JP | 2001022443 | 1/2001 |
| JP | 2001187009 | 7/2001 |
| JP | 2002182742 | 6/2002 |
| JP | 2002287824 | 10/2002 |
| JP | 2002355204 | 12/2002 |
| JP | 2002366228 | 12/2002 |
| JP | 2003280740 | 10/2003 |
| JP | 2004096253 | 3/2004 |
| JP | 2004166968 | 6/2004 |
| JP | 2004198212 | 7/2004 |
| JP | 2004303134 | 10/2004 |
| JP | 200540597 | 2/2005 |
| JP | 2005124753 | 5/2005 |
| JP | 2005141636 | 6/2005 |

(56) References Cited

FOREIGN PATENT DOCUMENTS

| | | |
|---|---|---|
| JP | 2005314116 | 11/2005 |
| JP | 2006015113 | 1/2006 |
| JP | 2006087507 | 4/2006 |
| JP | 2006231477 | 9/2006 |
| JP | 2006314669 | 11/2006 |
| JP | 2007014369 | 1/2007 |
| JP | 2007070658 | 3/2007 |
| JP | 2007143645 | 6/2007 |
| JP | 2006185438 | 7/2007 |
| JP | 2007213236 | 8/2007 |
| JP | 2007226322 | 9/2007 |
| JP | 2007272665 | 10/2007 |
| JP | 2008132299 | 6/2008 |
| JP | 2008146617 | 6/2008 |
| JP | 2008290184 | 12/2008 |
| JP | 2008543394 | 12/2008 |
| JP | 2009500741 | 1/2009 |
| JP | 2009509220 | 3/2009 |
| JP | 2009193240 | 8/2009 |
| JP | 2010507169 | 3/2010 |
| JP | 201079869 | 4/2010 |
| JP | 2010526594 | 8/2010 |
| JP | 2010534825 | 11/2010 |
| JP | 2011045694 | 3/2011 |
| JP | 2011253361 | 12/2011 |
| JP | 2012216051 | 11/2012 |
| JP | 2013041506 | 2/2013 |
| JP | 201389256 | 5/2013 |
| JP | 2013089256 | 5/2013 |
| JP | 2013247986 | 12/2013 |
| JP | 2014023930 | 2/2014 |
| KR | 20040096253 | 11/2004 |
| KR | 20050003112 | 1/2005 |
| KR | 20070070658 | 7/2007 |
| KR | 20090028359 | 3/2009 |
| KR | 101231932 | 3/2013 |
| NL | 7408667 | 1/1975 |
| WO | 8804081 | 6/1988 |
| WO | 9303399 | 2/1993 |
| WO | 9638770 | 12/1996 |
| WO | 0036961 | 6/2000 |
| WO | 0036970 | 6/2000 |
| WO | 0038025 | 6/2000 |
| WO | 0182766 | 11/2001 |
| WO | 03022120 | 3/2003 |
| WO | 03024292 | 3/2003 |
| WO | 2004006034 | 1/2004 |
| WO | 2004082899 | 9/2004 |
| WO | 2007008148 | 1/2007 |
| WO | 2007028049 | 3/2007 |
| WO | 2007051972 | 5/2007 |
| WO | 2007065034 | 6/2007 |
| WO | 2008048260 | 4/2008 |
| WO | 2009132317 | 10/2009 |
| WO | 2013105431 | 7/2013 |
| WO | 2013157324 | 10/2013 |
| WO | 2014033055 | 3/2014 |
| WO | 2015016580 | 2/2015 |

OTHER PUBLICATIONS

Final Office Action for U.S. Appl. No. 15/101,510, dated Feb. 8, 2019, 16 pages.
"SM51 Series Opposed Mode Sensors, DC sensors with metal housings: SM51EB/RB, SM51EB6/RB6", Banner Engineering Corporation, pp. 1-24.
Andersson, et al., "ISR: An Intelligent Service Robot", Centre for Autonomous Systems, Royal Institute of Technology, S-100 44 Stockholm, Sweden, pp. 1-24.
Berlin, et al. "Development of a Multipurpose Mobile Robot for Concrete Surface Processing", A Status Report, Feb. 1992, Sweden, pp. 1-10.
Borenstein, et al. "Real-Time Obstacle Avoidance for Fast Mobile Robots", IEEE, Jan. 6, 1996, pp. 1-18.
Braunstingl, et al., "Fuzzy Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Caselli, et al. "Mobile Robot Navigation in Enclosed Large-Scale Space", Italy and U.S.A., pp. 1-5.
Cassens, et al. "Finishing and Maintaining Wood Floors", Wood Finishing, North Central Regional Extension Publication #136, pp. 1-8.
Chinese Office Action for Application No. 201380081331.6, dated Mar. 26, 2018 with translation, 27 pages.
Chinese Office Action for Chinese Applciation No. 201380081537.9, dated Jun. 4, 2018 with translation, 15 pages.
Chinese Office Action for Chinese Application No. 20130075510.9, dated Feb. 6, 2017 with translation, 14 pages.
Chinese Office Action for Chinese Application No. 201380075503.9, dated Feb. 13, 2017 with translation, 18 pages.
Chinese Office Action for Chinese Application No. 201380075503.9, dated Nov. 8, 2017 with translation, 16 pages.
Chinese Office Action for Chinese Application No. 201380075510.9, dated Oct. 27, 2017 with translation, 13 pages.
Chinese Office Action for Chinese Application No. 201380081103.9, dated Feb. 27, 2018 withtranslation, 19 pages.
Chinese Office Action for Chinese Application No. 201380081535.X, dated Mar. 26, 2018, 18 pages.
Chung et al., "Path Planning for a Mobile Robot With Grid Type World Model", Proceedings of the 1992 IEEE/RSJ International Conference on Intelligent Robots and Systems, Jul. 7-10, 1992, pp. 439-444.
Collins, et al. "Cerebellar Control of a Line Following Robot", Computer Science and Electrical Engineering Department, University of Queensland, St.Lucia, Queensland, 4072 A, pp. 1-6.
Decision for Refusal for Japanese Application No. 2016-526875, dated May 15, 2018 with translation, 6 pages.
Decision of Refusal for Japanese Application No. 2016-526945, dated May 7, 2017 with trasnslation, 5 pages.
Doty, et al. "Sweep Strategies for a Sensory-Driven, Behavior-Based Vacuum Cleaning Agent", 1993, Machine Intelligence Laboratory—Gainesville Florida, AAAI 1993 Fall Symposium Series—Research Triangle Park—Raleigh, NC, Oct. 22-24, 1993, pp. 1-6.
European Communication Pursuant to Article 94(3) for European Application No. 14176479.0, dated Nov. 27, 2017, 6 pages.
European Communication Pursuant to Article 94(3) for EP Application No. 13817911.4, dated Jan. 15, 2014, 8 pages.
Everett, Sensors for Mobile Robots Theory and Application, A.K. Peters, 1995, Chapters 1 and 3, 70 pages.
Everett, Sensors for Mobile Robots Theory and Application, A.K. Peters, Ltd., 1995, Chapters 15 and 16, 59 pages.
Everett, Sensors for Mobile Robots Theory and Application, A.K. Peters, Ltd., 1995, Chapters 6, 7 and 10, 79 pages.
Everett, Sensors for Mobile Robots Theory and Application, A.K. Peters, Ltd., 1995, Chapters, 4a nd 5, 68 pages.
Everett, et al. "Survey of Collision Avoidance and Ranging Sensors for Mobile Robots", Revision 1, Technical Report 1194, Dec. 1992, pp. 1-154.
Extended European Search Report for European Application No. 16176479.0, dated Nov. 11, 2016, 9 pages.
Extended European Search Report for European Application No. 18157403.9, dated Nov. 14, 2018, 12 pages.
Final Office Action for U.S. Appl. No. 14/409,291, dated Jun. 6, 2017, 21 pages.
Final Office Action for U.S. Appl. No. 14/784,106, dated Mar. 28, 2018, 8 pages.
Final Office Action for U.S. Appl. No. 15/100,667, dated Apr. 21, 2017, 26 pages.
Final Office Action for U.S. Appl. No. 15/100,667, dated Mar. 27, 2018, 23 pages.
Final Office Action for U.S. Appl. No. 15/101,212, dated Oct. 11, 2017, 7 pages.
Final Office Action for U.S. Appl. No. 15/102,017, dated Jun. 14, 201812 pages.
Final Office Action for U.S. Appl. No. 15/101,235, dated Jan. 11, 2018, 12 pages.

(56) References Cited

OTHER PUBLICATIONS

Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Gutman et al., AMOS: Comparison of Scan Matching Approaches for Self-Localization in Indoor Environments, 1996, IEEE, pp. 61-67.
Herbst, et al., "Micromouse Design Specifications", Jun. 2, 1998, pp. 1-22.
International Preliminary Report on Patentability for International Application No. PCT/EP2013/077377, dated Jun. 21, 2016, 12 pages.
International Preliminary Report on Patentability for International Application No. PCT/EP2013/077378, dated Jun. 21, 2016, 7 pages.
International Preliminary Report on Patentability for International Application No. PCT/ EP2013/077384, dated Jun. 21, 2016, 6 pages.
International Preliminary Report on Patentability for International Application No. PCT/EP2013/077385, dated Jun. 21, 2016, 7 pages.
International Preliminary Report on Patentability for International Application No. PCT/EP2013/077386, dated Jun. 21, 2016, 6 pages.
International Preliminary Report on Patentability for International Application No. PCT/EP2013/077387, dated Jun. 21, 2016, 9 pages.
International Preliminary Report on Patentability for International Application No. PCT/EP2013/077657, dated Jun. 21, 2016, 7 pages.
International Preliminary Report on Patentability for International Application No. PCT/EP2013/077661, dated Jun. 21, 2016, 11 pages.
International Preliminary Report on Patentability for International Application No. PCT/EP203/077380, dated Jun. 21, 2016, 6 pages.
International Search Report and Written Opinion for the International Searching for International Application No. PCT/EP2016/055547, dated Jan. 2, 2017, 10 pages.
International Search Report and Written Opinion of the International Searching Authoirty for International Application No. PCT/EP2015/040140, dated May 27, 2016, 11 pages.
International Search Report and Written Opinion of the International Searching Authority for *International Application No. PCT/EP2015/058377, dated Aug. 10, 2016, 15 pages.
International Search Report and Written Opinion of the International Searching Authority for International Application No PCT/EP2014/069073, dated May 12, 2015, 10 pages.
International Search Report and Written Opinion of the International Searching Authority for International Application No. PCT/EP2012/077377, dated Nov. 6, 2014, 18 pages.
International Search Report and Written Opinion of the International Searching Authority for International Application No. PCT/EP2013/077378, dated Apr. 9, 2014, 9 pages.
International Search Report and Written Opinion of the International Searching Authority for International Application No. PCT/EP2013/077380, dated Jul. 28, 2014, 8 pages.
International Search Report and Written Opinion of the International Searching Authority for International Application No. PCT/EP2013/077384, dated Aug. 14, 2016, 9 pages.
International Search Report and Written Opinion of the International Searching Authority for International Application No. PCT/EP2013/077385, dated May 27, 2015, 9 pages.
International Search Report and Written Opinion of the International Searching Authority for International Application No. PCT/EP2013/077386, dated Sep. 17, 2014, 9 pages.
International Search Report and Written Opinion of the International Searching Authority for International Application No. PCT/EP2013/077387, dated Sep. 30, 2014, 12 pages.
International Search Report and Written Opinion of the International Searching Authority for International Application No. PCT/EP2013/077661, dated Jun. 10, 2014, 15 pages.
International Search Report and Written Opinion of the International Searching Authority for International Application No. PCT/EP2014/069074, dated May 11, 2015, 9 pages.
International Search Report and Written Opinion of the International Searching Authority for International Application No. PCT/EP2014/077549, dated Jul. 27, 2015, 9 pages.
International Search Report and Written Opinion of the International Searching Authority for International Application No. PCT/EP2014/077947, dated Jul. 11, 2016, 14 pages.
International Search Report and Written Opinion of the International Searching Authority for International Application No. PCT/EP2014/077954, dated Oct. 12, 2015, 19pages.
International Search Report and Written Opinion of the International Searching Authority for International Application No. PCT/EP2014/078144, 7 pages.
International Search Report and Written Opinion of the International Searching Authority for International Application No. PCT/EP2016/060565, dated Feb. 15, 2017, 12 pages.
International Search Report and Written Opinion of the International Searching Authority for International Application No. PCT/EP2016/060571, dated Feb. 7, 2017, 8 pages.
International Search Report and Written Opinion of the International Searching Authority for International Application No. PCT/EP32013/077657, dated Aug. 18, 2014, 10 pages.
International Search Report and Written Opinion of the International Searching Authority for Internatonal Applicaion No. PCT/EP2014/0077142, dated Sep. 11, 2015, 8 pages.
International Search Report for International Application No. PCT/EP2013/057814 dated Dec. 20, 2013, 5pages.
International Search Report for International Application No. PCT/EP2013/057815 dated Apr. 2, 2014, 4 pages.
International Search Report for International Application No. PCT/EP2013/067500 dated Dec. 10, 2013, 4 pages.
Japanese Office Action for Application for Japanese Application No. 2015-528969, dated Apr. 7, 2017 with translation, 4 pages.
Japanese Office Action for Japanese Application No. 2016-506794, dated Feb. 7, 2017 with translation, 10 pages.
Japanese Office Action for Japanese Application No. 2016-506795 , dated Feb. 7, 2017 with translation, 6 pages.
Jenkins, "Practical Requirements for a Domestic Vacuum-Cleaning Robot", From: AAAI Technical Report FS-93-03., JRL Consulting, Menlo Park, California, pp. 85-90.
Jones et al., Mobile Robots Inspiration to Implementation, Second Edition, A.K. Peters, Ltd., 1999, Chapters 1 and 5, 72pages.
Jones etal., Mobile Robots Inspiration to Implementation, Second Edition, A.K. Peters , Ltd., 1999, Chapters 6 and 9, 56pages.
Jones etal., Mobile Robots Inspiration to Implementation, Second Edition, A.K. Peters, Ltd., 1999, Chapters 10 and 11, 45pages.
Jung, et al. "Whisker Based Mobile Robot Navigation", Wollongong, NSW 2500, Australia, pp. 1-8.
Krishna, et al., "Solving the Local Minima Problem for a Mobile Robot by Classification of Spatio-Temporal Sensory Sequences", Journal of Robotic Systems 17 (10), 2000, pp. 549-564.
Kube, "A Minimal Infrared Obstacle Detection Scheme", Department of Computing Science, University of Alberta, Edmonton, Alberta, Canada, The Robotics Practitioner, 2(2): 15-20, 1996, Oct. 23, 1998, pp. 1-8.
Larson, "RoboKent—a case study in man-machine interfaces" Industrial Robot, vol. 25 No. 2, 1998, pp. 95-100.
LeBouthillier, "W. Grey Walter and his Turtle Robots", The Robot Builder, vol. Eleven No. Five, May 1999, RSSC POB 26044, Santa Ana, CA, pp. 1-8.
Maaref, et al. "Sensor-based navigation of a mobile robot in an indoor environment", Robotics and Autonomous Systems, 2002, Elsevier, 18pages.
Michael Carsten Bosse, "Atlas: A Framework for Large Scale Automated Mapping and Localization", Massachusetts Institute of Technology, Feb. 2004, Part 2, 67 pages.
Michael Carsten Bosse, "Atlas: A Framework for Large Scale Automated Mapping and Localization", Massachusetts Institute of Technology, Feb. 2004, Part 1, 140 pages.
Non Final Office Action for U.S. Appl. No. 14/409,291, dated Dec. 28, 2016, 61 pages.
Non Final Office Action for U.S. Appl. No. 13/504,066, dated Nov. 5, 2018, 18 pages.

(56) References Cited

OTHER PUBLICATIONS

Non Final Office Action for U.S. Appl. No. 15/504,071, dated Nov. 2, 2018, 17 pages.
Non Final Office Action for U.S. Appl. No. 15/101,235, dated Nov. 1, 2017, 11 pages.
Non Final Office Action for U.S. Appl. No. 14/784,106, dated Oct. 19, 2017, 11 pages.
Non Final OFfice Action for U.S. Appl. No. 14/784,110, dated Aug. 16, 2018, 13 pages.
Non Final Office Action for U.S. Appl. No. 15/100,667, dated Nov. 29, 2017, 22 pages.
Non Final Office Action for U.S. Appl. No. 15/100,667, dated Sep. 12, 2016, 24 pages.
Non Final Office Action for U.S. Appl. No. 15/101,212, dated May 17, 2017, 8 pages.
Non Final Office Action for U.S. Appl. No. 15/101,235 dated Apr. 21, 2017, 10 pages.
Non Final Office Action for U.S. Appl. No. 15/101,235, dated Jun. 14, 2018, 11 pages.
Non Final Office Action for U.S. Appl. No. 15/101,257, dated Feb. 10, 2017, 10 pages.
Non Final Office Action for U.S. Appl. No. 15/101,510, dated Jul. 27, 2018, 17 pages.
Non Final Office Action for U.S. Appl. No. 15/101,515, dated Apr. 18, 2018, 14 pages.
Non Final Office Action for U.S. Appl. No. 15/102,015, dated Aug. 17, 2017, 13 pages.
Non Final Office Action for U.S. Appl. No. 15/102,017, dated Feb. 16, 2018, 12 pages.
Non Final Office Action for U.S. Appl. No. 15/102,017, dated Jan. 22, 2019, 15 pages.
Non Final Office Action for U.S. Appl. No. 15/321,333, dated Oct. 24, 2018, 10 pages.
Notice of Allowance for U.S. Appl. No. 15/100,667, dated Aug. 6, 2018, 22 pages.
Notice of Allowance for U.S. Appl. No. 14/409,291, dated Jun. 16, 2016, 13 pages.
Notice of Allowance for U.S. Appl. No. 14/409,291, dated Sep. 18, 2017, 8 pages.
Notice of Allowance for U.S. Appl. No. 14/784,106, dated Oct. 11, 2018, 7 pages.
Notice of Allowance for U.S. Appl. No. 15/101,212l dated Apr. 11, 2018, 9 pages.
Notice of Allowance for U.S. Appl. No. 15/101,257, dated Jul. 6, 2017, 9 pages.
Notice of Allowance for U.S. Appl. No. 15/101,515, dated Aug. 28, 2018, 11 pages.
Notice of Allowance for U.S. Appl. No. 15/102,015, dated Dec. 11, 2017, 8 pages.
Notice of Allowance for U.S. Appl. No. 15/102,295, dated Sep. 24, 2018, 9 pages.
Notice of Reasons for Rejection for Japanese Application No. 2016-526756, dated Aug. 10, 2017, with translation, 6 pages.
Notice of Reasons for Rejection for Japanese Application No. 2016-526759, dated Aug. 24, 2017 with translation, 9 pages.
Notice of Reasons for Rejection for Japanese Application No. 2016-526765, dated Aug. 25, 2017 with translation, 7 pages.
Notice of Reasons for Rejection of Japanese Application No. 2016-526764, dated Aug. 25, 2017 with translation, 6 pages.
Notification fo Reasons for Refusal for Japanese Application No. 2016-526875, dated Oct. 31, 2017 with translation, 10 pages.
Notification of Reasons for Refusal for Japanese Application No. 2016-526765, dated May 15, 2018 with translation, 6 pages.
Notification of Reasons for Refusal for Japanese Application No. 2016-526945, dated Oct. 31, 2017 with translation, 8 pages.
Notification of Reasons for Refusal for Japanese application No. 2016-568949, dated Oct. 9, 2018 with translation, 6 pages.
Notification of Reasons for Refusal for Japanese Application No. 2017-501374, dated Mar. 6, 2016 with translation, 8 pages.
Notification of Reasons for Rejection for Japanese Application No. 2016-526947, dated Sep. 21, 2017 with translation 8 pages.
Oren, Reply to Office Action dated Jun. 23, 2014, Docket No. HI-0794 U.S. Appl. No. 13/757,985, pp. 1-10.
Pack, et al., "Constructing a Wall-Follower Robot for a Senior Design Project", 1996 ASEE Annual Conference Proceedings, Session 1532, pp. 1-7.
Position_Definition of Position by Merriam-Webster.pdf (Position | Definition of Position by Merriam-Webster, Oct. 16, 2016, Merriam-Webster, https://www.merriam-webster.com/dictinary/position, pp. 1-15).
Report of Reconsideration for Japanese Application No. 2016-011556, dated Oct. 24, 2018, 2 pages.
Saffiotti, "Fuzzy logic in Autonomous Robot Navigation", a case study, Nov. 1995 Revised: Aug. 1997, IRIDIA, Universite Libre de Bruxelles, Belgium, Technical Report TR/IRIDIA/ 95 25, Cover page + pp. 1-14.
Written Opinion for International Application No. PCT/EP2013/067500 dated Dec. 10, 2013, 7 pages.
Yamamoto, "Sozzy: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.

ROBOTIC CLEANING DEVICE

This application is a U.S. National Phase application of PCT International Application No. PCT/EP2016/060571, filed May 11, 2016, which is incorporated by reference herein.

TECHNICAL FIELD

The present invention generally relates to robotic cleaning devices. In particular, a robotic cleaning device comprising at least one drive wheel and a first and second spring member associated with the at least one drive wheel is provided.

BACKGROUND

Some robotic cleaning devices, such as vacuum cleaning robots, use tension spring suspensions for the drive wheels. The spring forces facilitate travelling on thick carpets and climbing over thresholds, electrical cables and other objects.

Furthermore, some robotic cleaning devices rely partly or fully on odometry, i.e. the use of the wheel rotation as feedback to control the position of the robot. If a wheel slips on the travelling surface, the position control of the robot might be deteriorated.

WO 2014151501 A1 discloses a mobile surface cleaning robot where each drive wheel is rotatably supported by a drive wheel suspension arm having a first end pivotally coupled to the robot body and a second end rotatably supporting the drive wheel, and a drive wheel helical suspension spring biasing the drive wheel towards the floor surface. This helical suspension spring cannot provide the same force both at its minimum stretch and at its maximum stretch. In other words, when the robot adopts a low position, where the robot body is close to the ground surface, the suspension spring is in an extended state and thereby provides a relatively high force (according to Hooke's law). However, when the robot adopts a raised position, where the robot body is raised higher above the ground surface, the suspension spring is in a less extended state and thereby provides a relatively low force. Thus, the force generated by the suspension spring that pushes the drive wheel downwardly against the ground surface is rather low when the robot adopts the raised position. Thereby, there is an increased risk for the wheel to slip or spin and a consequential deterioration of the position control of the robot.

SUMMARY

One object of the present disclosure is to provide a robotic cleaning device with an improved travel performance.

A further object of the present disclosure is to provide a robotic cleaning device with an improved cleaning performance.

A still further object of the present disclosure is to provide a robotic cleaning device an improved grip between one or more drive wheels and a ground surface, in particular an improved grip between one or more drive wheels and a ground surface when the robotic cleaning device adopts a raised position.

A still further object of the present disclosure is to provide a robotic cleaning device having a compact and simple spring arrangement for one or more of its drive wheels.

According to one aspect, there is provided a robotic cleaning device comprising a main body; at least one drive wheel for driving the robotic cleaning device on a horizontal ground surface; at least one linking member rotationally coupled to the main body about a suspension axis and rotationally supporting the at least one drive wheel about a drive wheel axis such that by rotating the linking member about the suspension axis in a first direction, at least a section of the main body can be raised from a lowered position, closer to the ground surface, to a raised position, further away from the ground surface; and a first spring member and a second spring member each arranged to provide a moment on the linking member about the suspension axis in the first direction to press the at least one drive wheel towards the ground surface; wherein the moment provided by the first spring member is higher in the lowered position than in the raised position and the moment provided by the second spring member is higher in the raised position than in the lowered position.

The first spring member may be arranged to provide a first, higher moment on the linking member about the suspension axis in the first direction when the main body is in the lowered position and to provide a second, lower moment on the linking member about the suspension axis in the first direction when the main body is in the raised position. As an alternative, the first spring member may be arranged to provide a moment on the linking member about the suspension axis in the first direction when the main body is in the lowered position and to provide no, or substantially no (e.g. less than 2% of the moment provided when the main body is in the lowered position), moment on the linking member about the suspension axis when the main body is in the raised position.

The second spring member may be arranged to provide no, or substantially no (e.g. less than 2% of the moment provided when the main body is in the raised position), moment on the linking member about the suspension axis when the main body is in the lowered to position and to provide a moment on the linking member about the suspension axis in the first direction when the main body is in the raised position. As an alternative, the second spring member may be arranged to provide a first, lower moment on the linking member about the suspension axis in the first direction when the main body is in the lowered position and to provide a second, higher moment on the linking member about the suspension axis in the first direction when the main body is in the raised position.

The first spring member and the second spring member may be arranged such that the sum of the moments from the first spring member and the second spring member acting on the linking member about the suspension axis in the first direction when the main body is in the lowered position is the same, or substantially the same (e.g. less than 5% difference), as the sum of the moments in the raised position.

When the main body is in the raised position or in the lowered position, also the linking member may be said to be in the respective raised position or lowered position. Throughout the present disclosure, a raised position of the linking member may be a maximally raised position, or any intermediate position between the lowered position and the maximally raised position. In the maximally raised position, the linking member may be inclined 30-60°, such as 40-50°, such as 45°, with respect to the horizontal ground surface. The maximally raised position of the linking member may be mechanically defined by a protruding structure on the linking member that engages the main body (or vice versa) to stop further rotation of the linking member in the first direction about the suspension axis when the linking member has reached the maximally raised position.

The robotic cleaning device may be constituted by an automatic, self-propelled machine for cleaning a surface, e.g. a robotic vacuum cleaner, a robotic sweeper or a robotic floor washer. The robotic cleaning device according to the present disclosure can be mains-operated and have a cord, be battery-operated or use any other kind of suitable energy source, for example solar energy.

The main body may be of various different designs, such as generally circular or generally triangular. The main body may have a flat appearance oriented substantially parallel with the ground surface. A dust collector bin, a battery, a suction fan, a suction nozzle and drive electronics etc. may be provided in the main body. Throughout the present disclosure, the main body may alternatively be referred to as a chassis. Although the robotic cleaning device is most typically commanded to travel on horizontal ground surfaces, it may also travel on uneven and/or slightly inclined surfaces.

As used herein, a vertical orientation is an orientation substantially perpendicular to the ground surface on which the robotic cleaning device travels and a horizontal orientation is an orientation substantially parallel with the ground surface on which the robotic cleaning device travels. A substantially perpendicular/parallel relationship as used herein includes a perfectly perpendicular/parallel relationship as well as deviations from a perfectly perpendicular/parallel relationship with up to 5%, such as up to 2%.

According to one realization, the robotic cleaning device comprises two drive wheels for driving the robotic cleaning device on the ground surface. The two drive wheels may be substantially concentrically arranged about concentric rotation axes substantially perpendicular to a forward travel direction of the robotic cleaning device. The drive wheels may comprise any suitable structure to increase the friction to the ground surface, such as rubber tires.

The linking member may be constituted by a suspension arm or swing arm, i.e. it may have an elongated appearance arranged in and operating in a substantially vertical plane. The linking member may be formed from one single piece of material (e.g. hard plastic) and/or may be rigid.

The suspension axis may for example comprise a pivot pin or hinge shaft connected to the main body in order to rotationally couple the linking member to the main body for rotation about the suspension axis. The suspension axis may be arranged substantially perpendicular to a forward travel direction of the robotic cleaning device.

Furthermore, the drive wheel axis may comprise a pivot pin or hinge shaft connected to the linking member in order to rotationally support the drive wheel about the drive wheel axis. Each drive wheel axis may be arranged substantially perpendicular to a forward travel direction of the robotic cleaning device.

The floor clearance control of the robotic cleaning device as described herein may be implemented entirely mechanically. For example, if the robotic cleaning device encounters an obstacle, the impact force from the obstacle (e.g. a carpet or a threshold) on the drive wheel together with the moment provided on the linking member about the suspension axis in the first direction by the first spring member (possibly also by the second spring member) may be sufficient to raise the main body from the lowered position to the raised position. Once the impact force from the obstacle is removed, the weight of the main body overcomes the moment provided on the linking member about the suspension axis in the first direction by the second spring member (possibly also by the first spring member) and the main body is allowed to again adopt the lowered position. When the main body is lowered from the raised position to the lowered position, the linking member rotates about the suspension axis in a second direction, opposite to the first direction.

The one or more drive wheels may be trailing with respect to the linking member, i.e. for each drive wheel, the suspension axis may be arranged in front of the drive wheel axis with respect to a forward travel direction of the robotic cleaning device.

Throughout the present disclosure, the lowered position and the raised position may alternatively be referred to as a low clearance position or normal mode and a high clearance position or carpet mode, respectively.

The first spring member may be constituted by a tension spring, for example a coil spring. The tension spring may be extended a first, longer distance when the main body is in the lowered position and be extended a second, shorter distance when the main body is in the raised position. Thereby, the first spring member is arranged to provide a higher moment on the linking member about the suspension axis in the first direction in the lowered position of the main body than in the raised position of the main body.

Alternatively, the first spring member may be constituted by a compression spring. The compression spring may be arranged to provide a higher moment on the linking member about the suspension axis in the first direction in the lowered position of the main body than in the raised position. That is, the compression spring may be compressed a first, longer distance (more compressed) when the main body is in the lowered position and be compressed a second, shorter distance (less compressed) when the main body is in the raised position. The compression spring may for example be vertically arranged in front of the suspension axis, as seen in the forward travel direction of the robotic cleaning device.

As a further alternative, the first spring member may be constituted by a torsion spring arranged concentric with the suspension axis. The torsion spring may be arranged to provide a higher moment on the linking member about the suspension axis in the first direction in the lowered position than in the raised position. It is also possible to implement the first spring member as a cantilever spring.

The second spring member may be constituted by a cantilever spring biased against the linking member. One example of a cantilever spring is a blade spring.

The second spring member may comprise a fixed section and a free section, wherein the fixed section is fixed with respect to the main body and the free section is biased against the linking member. The second spring member may be substantially horizontal and may be arranged to exert a downward biasing force on the linking member.

The linking member may comprise a cam profile engaged at a second spring engagement point by the free section of the second spring member. The cam profile may be designed such that the second spring engagement point along the second spring member is substantially maintained in a horizontal plane fixed with respect to the main body as the linking member rotates about the suspension axis.

The drive wheel axis may be positioned vertically between the second spring engagement point and the suspension axis in the lowered position and the suspension axis may be positioned vertically between the second spring engagement point and the drive wheel axis in the raised position. In the lowered position, the vertical distance between the suspension axis and the drive wheel axis may be 30-50%, such as 40%, of the vertical distance between the suspension axis and the second spring engagement point. In the raised position, the vertical distance between the drive wheel axis and the suspension axis may be 5-20%, such as 10%, of the vertical distance between the drive wheel axis and the second spring engagement point.

The suspension axis and the second spring engagement point may be substantially horizontally aligned in the lowered position and the second spring engagement point may be positioned horizontally between the suspension axis and the drive wheel axis in the raised position. By positioning the second spring engagement point horizontally aligned or substantially horizontally aligned in the lowered position and by arranging the second spring member to provide a biasing force acting downwardly on the linking member, no or substantially no torque is generated about the suspension axis by the second spring member when the linking member is in the lowered position. In the raised position, the horizontal distance between the suspension axis and the second spring engagement point may be 20-40%, such as 30%, of the horizontal distance between the suspension axis and the drive wheel axis.

A moment arm of the free section of the second spring member biased against the linking member acting on the suspension axis may be substantially zero when the main body is in the lowered position.

The first spring member and the second spring member may be substantially aligned in the lowered position and/or the raised position.

The first spring member and the second spring member may be substantially aligned (i.e. substantially flush) with an upper edge of the linking member in the lowered position. The upper edge of the linking member may be substantially horizontal when the linking member is in the lowered position. In case the linking member has an elongated appearance, the upper edge of the linking member may be substantially parallel to a general extension direction of the linking member. The upper edge may thus be inclined, for example about 45°, with respect to the horizontal ground surface when the linking member adopts the raised position.

The first spring member and the second spring member may be oriented substantially parallel with the ground surface in the lowered position and/or the raised position. For example, both the first spring member and the second spring member may be substantially horizontally aligned in the lowered position and in the raised position. Although this configuration may be preferable in terms of space limitations, other orientations of the first spring member and the second spring member, either in one or both of the lowered position and the raised position, are conceivable.

The first spring member may be attached to the linking member at a first spring engagement point and the drive wheel axis may be positioned vertically between the first spring engagement point and the suspension axis in the lowered position and the suspension axis may be positioned vertically between the first spring engagement point and the drive wheel axis in the raised position. The first spring engagement point may be constituted by a protrusion, such as a hook, protruding upwardly (in the lowered position) from the linking member. The protrusion may be integrally formed with the linking member. The first spring member may also be attached to the main body in a corresponding manner, e.g. to a hook provided on the main body.

In the lowered position, the vertical distance between the suspension axis and the drive wheel axis may be 30-50%, such as 40%, of the vertical distance between the suspension axis and the first spring engagement point. In the raised position, the vertical distance between the drive wheel axis and the suspension axis may be 5-20%, such as 10%, of the vertical distance between the drive wheel axis and the first spring engagement point.

The first spring member may be attached to the linking member at a first spring engagement point and the suspension axis may be positioned horizontally between the first spring engagement point and the drive wheel axis in the lowered position and the first spring engagement point may be positioned horizontally between the suspension axis and the drive wheel axis in the raised position. For example, the horizontal distance between the first spring engagement point and the suspension axis may be 5-20%, such as 10%, of the horizontal distance between the first spring engagement point and the drive wheel axis in the lowered position. In the raised position, the horizontal distance between the suspension axis and the first spring engagement point may be 20-40%, such as 30%, of the horizontal distance between the suspension axis and the drive wheel axis.

The first spring member may be attached to the linking member at a first spring engagement point and the suspension axis and the first spring engagement point may be substantially horizontally aligned in the lowered position and the first spring engagement point may be positioned horizontally between the suspension axis and the drive wheel axis in the raised position. For example, the horizontal distance between the suspension axis and the first spring engagement point may be 40-60%, such as 50%, of the horizontal distance between the suspension axis and the drive wheel axis in the raised position. As used herein, a horizontal distance and a vertical distance refer to the horizontal component and the vertical component, respectively, of the distance.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
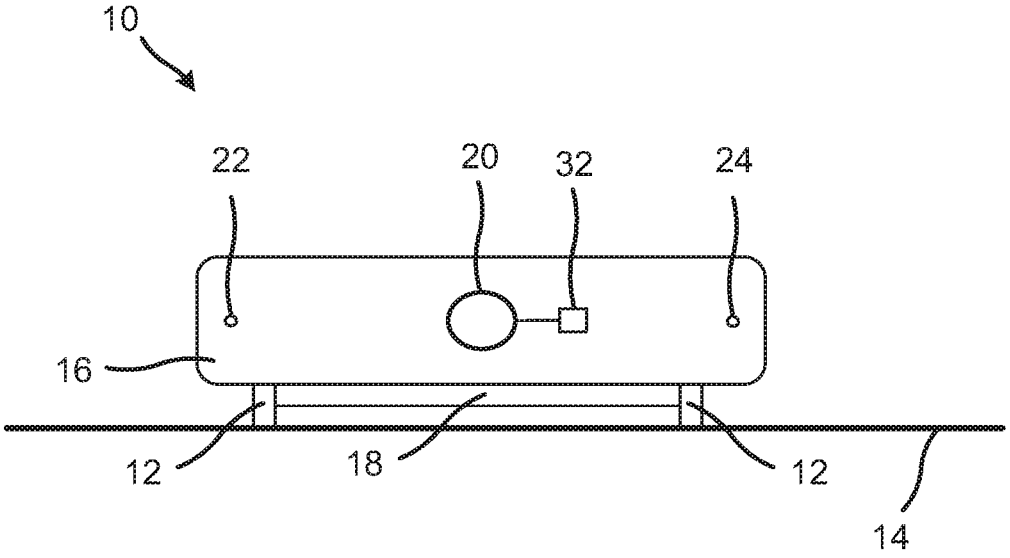
FIG. 1: schematically represents a front view of a robotic cleaning device in a lowered position.

In the following, a robotic cleaning device comprising at least one drive wheel and a first and second spring member associated with the at least one drive wheel will be described.

The same reference numerals will be used to denote the same or similar structural features.

FIG. 1 schematically represents a front view of a robotic cleaning device 10 in a lowered position. The robotic cleaning device 10 comprises two drive wheels 12 for driving the robotic cleaning device 10 over a surface 14 to be cleaned and a main body 16. The clearance between the main body 16 and the surface 14 may be adjusted as will be described in the following.

The drive wheels 12 may be driven jointly to drive the robotic cleaning device 10 in a forward travel direction or in a backward direction, or independently to turn the robotic cleaning device 10. For example, one drive wheel 12 may be driven forwards and the other drive wheel 12 may be driven backwards in order to turn the robotic cleaning device 10 substantially on the spot or one drive wheel 12 may be driven forwards and the other drive wheel 12 may be locked in order to turn the robotic cleaning device 10 around the stationary drive wheel 12.

The robotic cleaning device 10 optionally comprises a rotatable brush roll 18 arranged horizontally at its front to enhance the dust and debris collecting properties of the robotic cleaning device 10. The robotic cleaning device 10 may further optionally comprise a 3D sensor system comprising a camera 20 and two line lasers 22, 24, which may be horizontally or vertically oriented line lasers.

Figure 2:
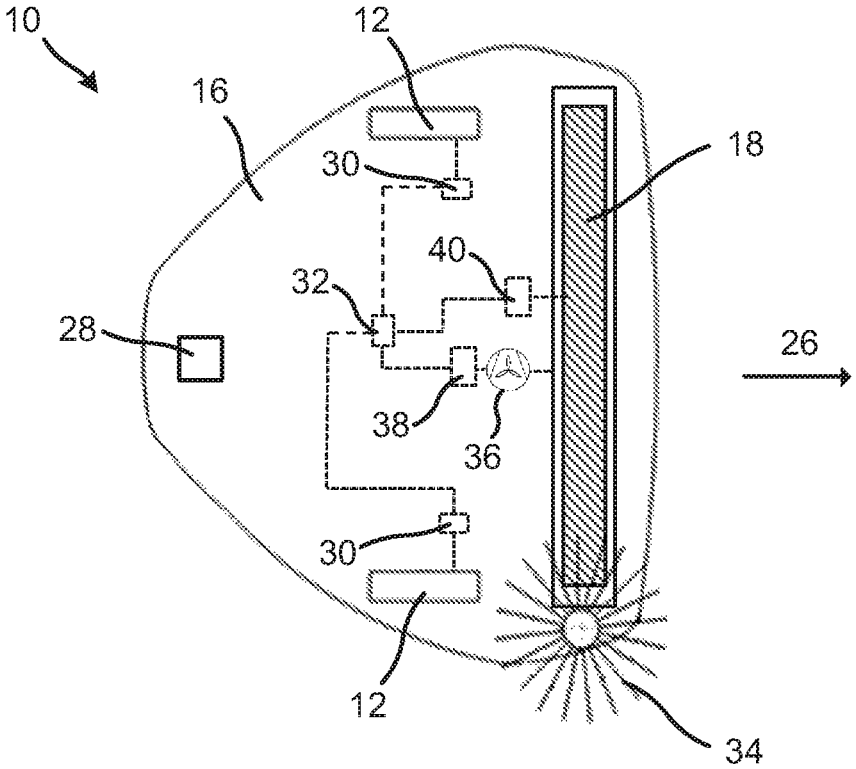
FIG. 2: schematically represents a bottom view of the robotic cleaning device.

FIG. 2 schematically represents a bottom view of the robotic cleaning device 10. As can be seen in FIG. 2, the main body 16 has a substantially triangular appearance parallel with the horizontal ground surface 14 and has a substantially straight side facing in a forward travel direction 26 of the robotic cleaning device 10. At the rear portion of the main body 16, a caster wheel 28 is disposed to support a rearward portion of the main body 16. In this implementation, the caster wheel 28 is arranged to swivel about a vertical axis.

The robotic cleaning device 10 further comprises two wheel motors 30, one associated with each drive wheel 12, to rotationally drive the respective drive wheel 12 and a control unit 32 to control the drive of the respective wheel motor 30. Various different types of transmissions may be used in order to transmit a driving force from the wheel motor 30 to the drive wheel 12, such as a gear transmission or a belt transmission.

FIG. 2 further shows that the robotic cleaning device 10 may comprise, a rotatable side brush 34, a suction fan 36 drivable by a fan motor 38 communicatively connected to the control unit 32 from which the fan motor 38 receives instructions for controlling the suction fan 36 and a brush roll motor 40 operatively coupled to the brush roll 18 to control its rotation in line with instructions received from the control unit 32.

Figure 3:
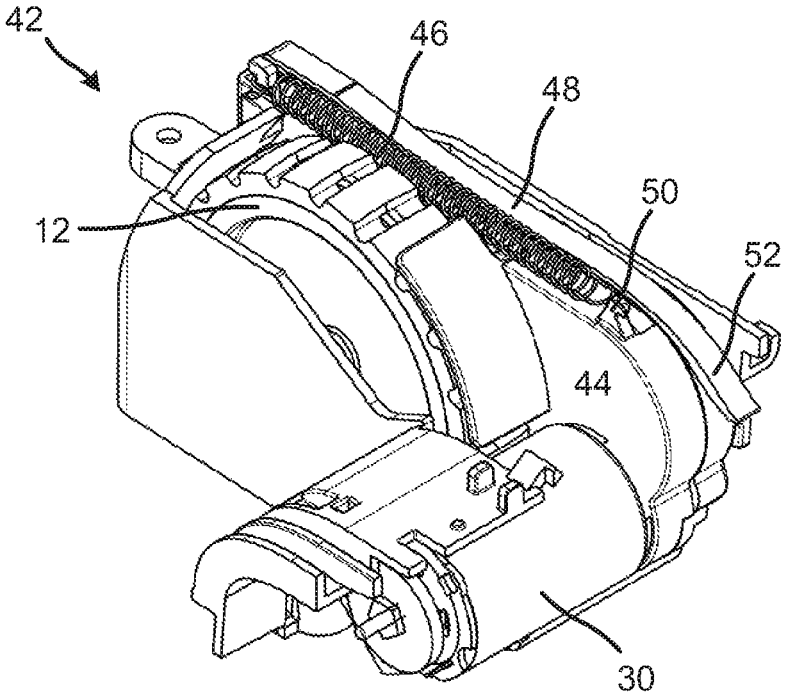
FIG. 3: schematically represents a front perspective view of a drive wheel assembly of the robotic cleaning device in the lowered position.
Figure 4:
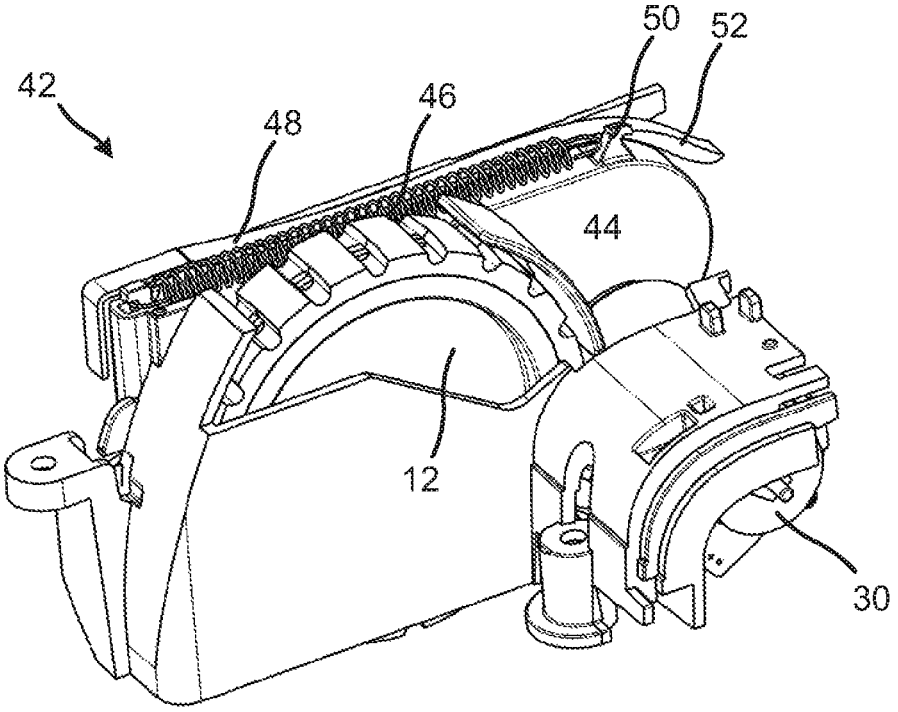
FIG. 4: schematically represents a rear perspective view of the drive wheel assembly in the lowered position.

FIGS. 3 and 4 schematically represent a front perspective view and a rear perspective view, respectively, of one of two drive wheel assemblies 42 of the robotic cleaning device 10 in the lowered position. The lowered position may for example be adopted when cleaning a hard floor (e.g. parquet) and there are no obstacles to be climbed. In addition to the previously mentioned drive wheel 12 and wheel motor 30, the drive wheel assembly 42 comprises a linking member 44, a first spring member 46 and a second spring member 48. The linking member 44 is pivotally connected to the main body 16 and rotationally supports the drive wheel 12.

In the following, the first spring member 46 is exemplified as a tension spring and the second spring member 48 is exemplified as a cantilever spring in the form of a blade spring. However, these types of springs are not essential for the general function to provide a pressing force on the drive wheel 12 in both the lowered position and in the raised position.

The first spring member 46 is connected between the main body 16 and the linking member 44. The attachment point between the first spring member 46 and the linking member 44 is referred to as a first spring engagement point 50. The second spring member 48 comprises one section fixed with respect to the main body 16 and an opposing free section 52. In the illustrated lowered position, the first spring member 46 is in an extended state to pull the first spring engagement point 50 and the second spring member 48 provides a downwardly acting force on the linking member 44.

Both the first spring member 46 and the second spring member 48 are substantially horizontally aligned and arranged parallel to each other. In the illustrated implementation, both the first spring member 46 and the second spring member 48 are flush with an upper edge of the linking member 44. As can be seen in FIGS. 3 and 4, the first spring member 46 and the second spring member 48 are aligned in a compact arrangement in the lowered position.

Figure 5:
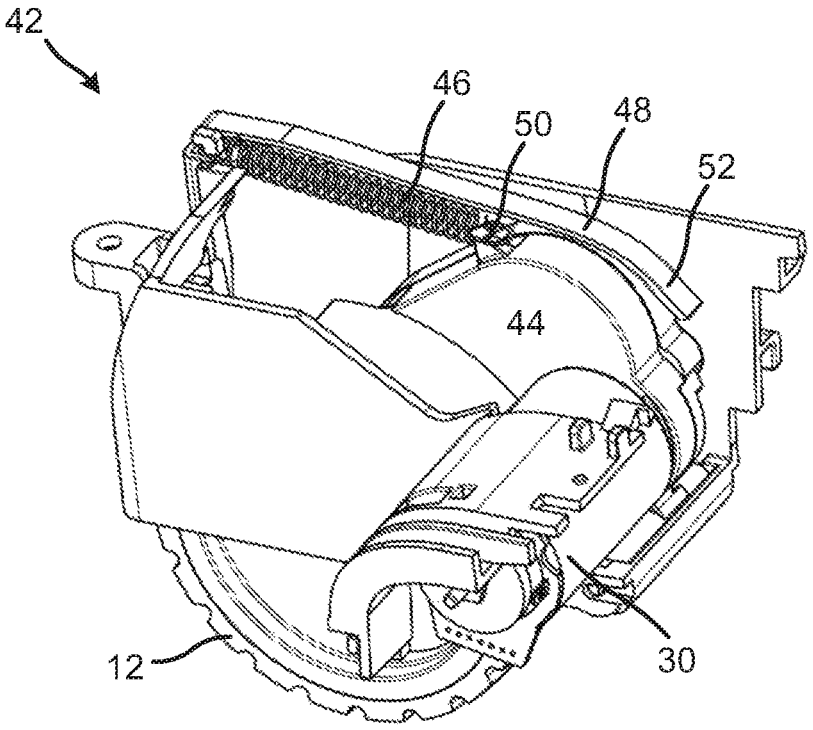
FIG. 5: schematically represents a front perspective view of the drive wheel assembly in a raised position.
Figure 6:
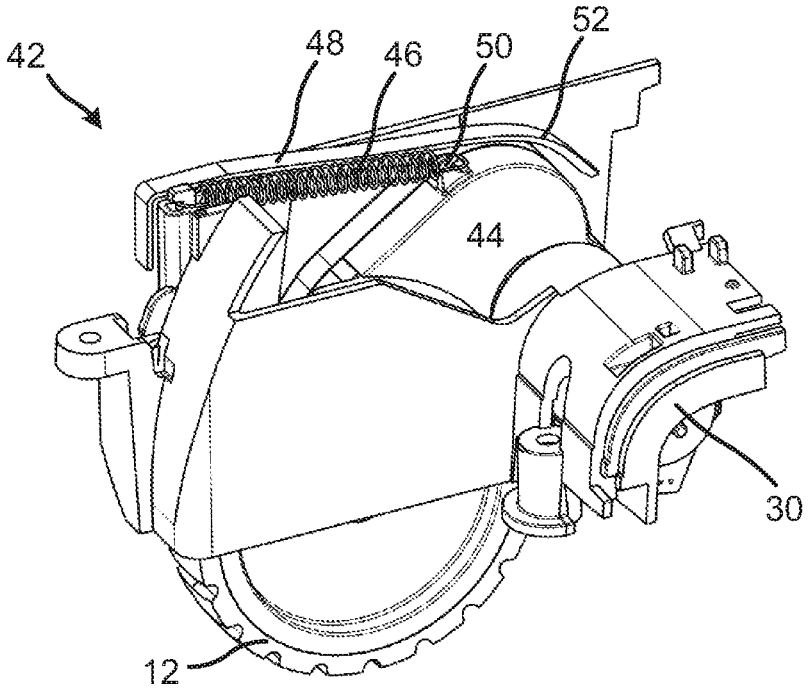
FIG. 6: schematically represents a rear perspective view of the drive wheel assembly in the raised position.

FIGS. 5 and 6 schematically represent a front perspective view and a rear perspective view, respectively, of the drive wheel assembly 42 in the raised position. The raised position may be adopted when the robotic cleaning device 10 travels on a thick carpet and/or when climbing an obstacle. In the raised position, the drive wheels 12 of the robotic cleaning device 10 are moved out from the main body 16 and downwards towards the ground surface 14 (e.g. floor).

In this state, the first spring member 46 still pulls the linking member 44 at the first spring engagement point 50. However, since the first spring member 46 is in a less extended state in the illustrated raised position, the force by the first spring member 46 is lower in raised position as compared to the lowered position. The second spring member 48 also provides a downwardly acting force on the linking member 44 in the raised position. Also in the raised position, the first spring member 46 and the second spring member 48 are aligned in a compact arrangement.

Figure 7:
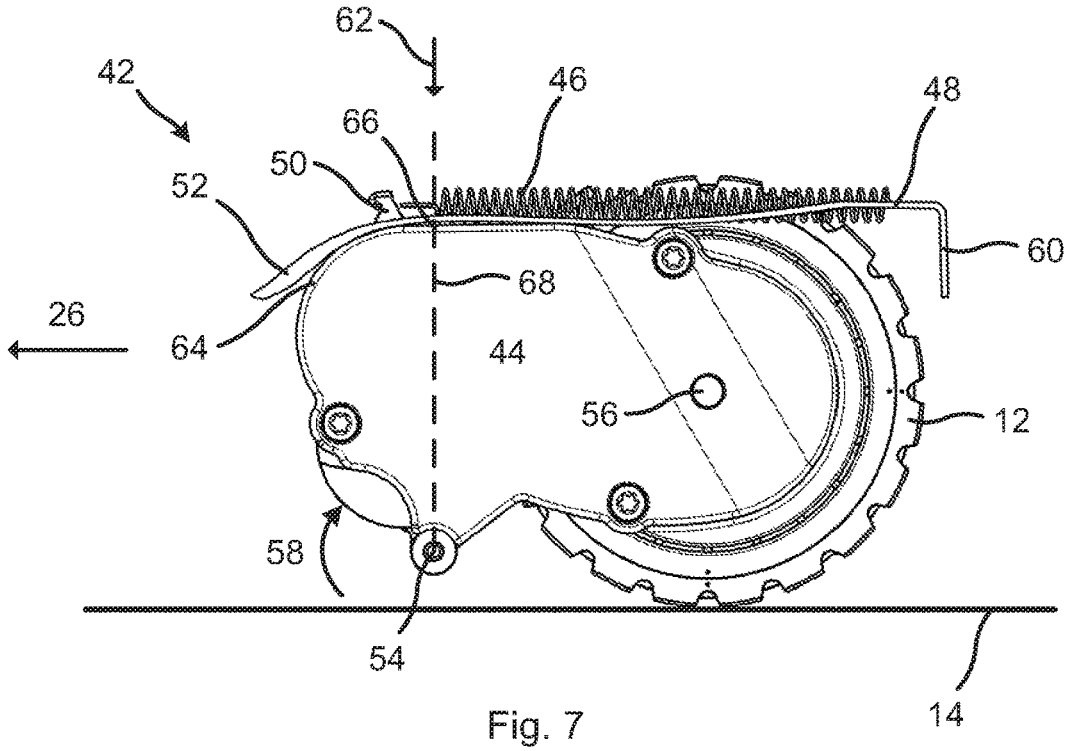
FIG. 7: schematically represents a side view of the drive wheel assembly in the lowered position.
Figure 8:
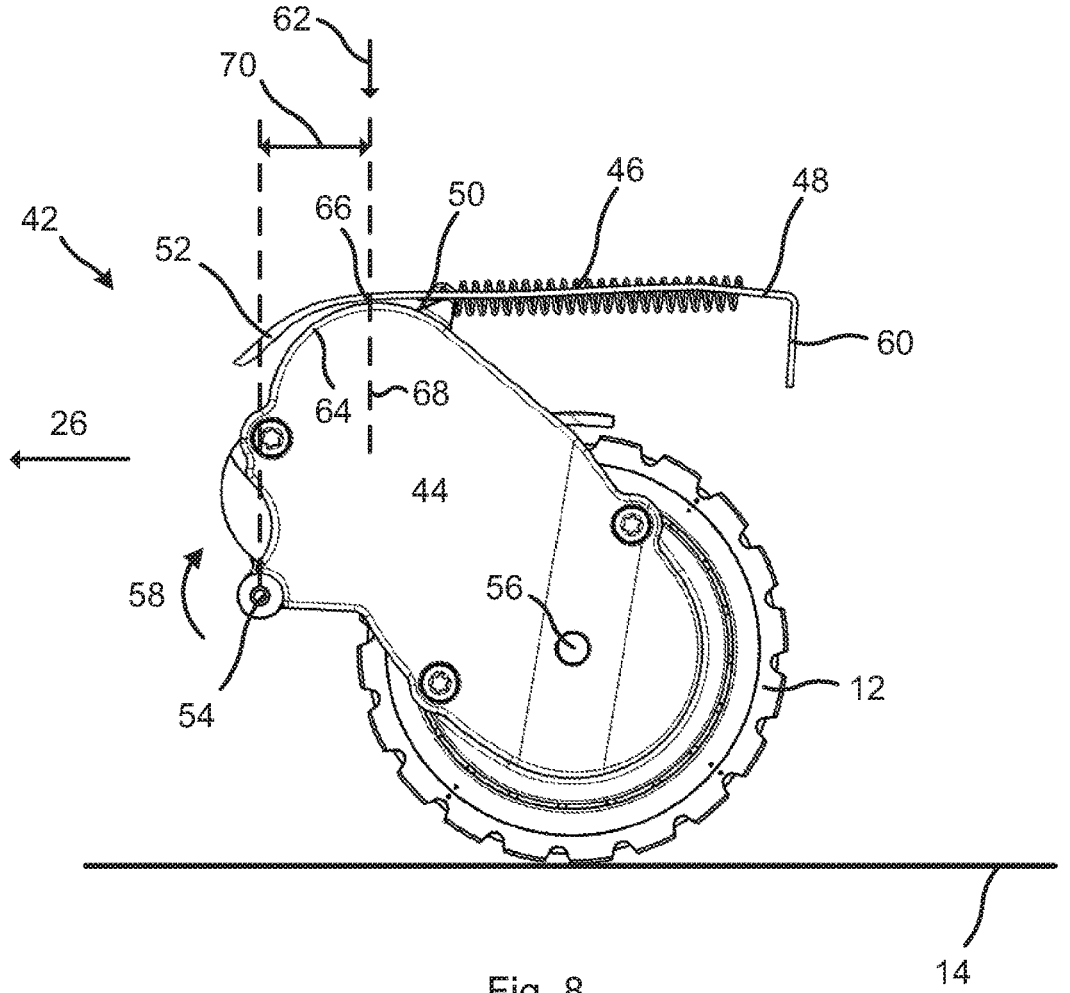
FIG. 8: schematically represents a side view of the drive wheel assembly in the raised position.

FIG. 7 schematically represents a side view of the drive wheel assembly 42 in the lowered position and FIG. 8 schematically represents a side view of the drive wheel assembly 42 in the raised position.

The linking member 44 is rotationally coupled to the main body 16 about a suspension axis 54. The linking member 44 is further arranged to rotationally support the associated drive wheel 12 about a drive wheel axis 56. Both the suspension axis 54 and the drive wheel axis 56 are oriented substantially perpendicular to the forward travel direction 26 of the robotic cleaning device 10. As can be seen in FIGS. 7 and 8, the suspension axis 54 is arranged in front of the drive wheel axis 56, as seen in the forward travel direction 26, and the linking member 44 may therefore be said to constitute a trailing suspension. In the lowered position, a general extension direction of the linking member 44 is substantially parallel with the forward travel direction 26 of the robotic cleaning device 10.

When the linking member 44 is rotated about the suspension axis 54 in a first direction 58, the linking member 44 can be moved from the lowered position, as illustrated in FIG. 7, to the raised position, as illustrated in FIG. 8. The raised position is here constituted by a maximally raised position where the linking member 44 is inclined approximately 45° with respect to the horizontal ground surface 14, but may also be constituted by an intermediate position. Since the suspension axis 54 is raised higher above the horizontal ground surface 14 in the raised position in FIG. 8 than in the lowered position in FIG. 7, also a section of the main body 16, to which the linking member 44 is attached, is raised higher above the horizontal ground surface 14 in the raised position than in the lowered position.

This clearance control may be entirely independent between the two drive wheel assemblies 42 of the robotic cleaning device 10. For example, one linking member 44 may adopt the lowered position while the other linking member 44 adopts the raised position, and vice versa. Of course, both linking members 44 may also simultaneously adopt the lowered position or the raised position.

Since the first spring member 46 is extended in the lowered position in FIG. 7, it generates a force on the first spring engagement point 50, here implemented as an upwardly protruding hook, to which the first spring member 46 is attached. This force acting on the first spring engagement point 50 in turn generates a moment on the linking member 44 about the suspension axis 54 in the first direction 58. Thereby, the first spring member 46 is arranged to provide a moment on the linking member 44 about the suspension axis 54 in the first direction 58 to press the drive wheel 12 downwardly towards the ground surface 14.

In the raised position in FIG. 8 however, the first spring member 46 is less extended in comparison with FIG. 7. As a result, in the raised position, the force acting on the first spring engagement point 50 and the consequential moment acting on the linking member 44 about the suspension axis 54 in the first direction 58 are lower in comparison with the lowered position. The first spring member 46 is thereby arranged to provide a higher moment in the lowered position than in the raised position. More specifically, the first spring member 46 is thereby arranged to provide a first, higher moment on the linking member 44 about the suspension axis 54 in the first direction 58 when the main body 16 is in the lowered position and to provide a second, lower moment on the linking member 44 about the suspension axis 54 in the first direction 58 when the main body 16 is in the raised position.

The second spring member 48 comprises a fixed section 60 that is fixed with respect to the main body 16 and a free section 52 that is biased against the linking member 44. The second spring member 48 is biased downwardly and provides a downward force 62 on a cam profile 64 of the linking member 44. The contact point between the second spring member 48 and the linking member 44 is referred to as a second spring engagement point 66.

As illustrated by a vertical line 68 in FIG. 7, the force 62 by the second spring member 48 acting on the linking member 44 is directed towards the suspension axis 54. As a consequence, in the lowered position, the second spring member 48 does not generate any moment on the linking member 44 about the suspension axis 54.

When the linking member 44 starts to rotate about the suspension axis 54 in the first direction 58, for example if the robotic cleaning device 10 encounters an obstacle so that the impact force from the obstacle on the drive wheel 12 together with the moment provided on the linking member 44 about the suspension axis 54 in the first direction 58 by the first spring member 46 overcomes the gravital force from the main body 16 acting on the drive wheel assembly 42, the second spring engagement point 66 is horizontally displaced (in a backward direction, opposite to the forward travel direction 26) with respect to the suspension axis 54. As a consequence, the downward force 62 from the second spring member 48 acting on the linking member 44 starts to generate a moment on the suspension axis 54 in the first direction 58. The moment arm of this moment is illustrated by the line 70.

In other words, the second spring member 48 is arranged to provide a higher moment on the linking member 44 in the raised position than in the lowered position. More specifically, the second spring member 48 is thereby arranged to provide no moment on the linking member 44 about the suspension axis 54 when the main body 16 is in the lowered position and to provide a moment on the linking member 44 about the suspension axis 54 in the first direction 58 when the main body 16 is in the raised position.

As the linking member 44 rotates about the suspension axis 54 from the lowered position to the raised position, the second spring engagement point 66 travels along the cam profile 64 of the linking member 44. As can be gathered from FIGS. 7 and 8, the cam profile 64 is designed such that the second spring engagement point 66 is substantially maintained in the same horizontal plane with respect to the main body 16 as the linking member 44 rotates about the suspension axis 54. In other words, the second spring member 48 is maintained substantially horizontal and is lifted together with the main body 16 as the main body 16 moves from the lowered position to the raised position, and vice versa.

FIG. 7 shows that the drive wheel axis 56 is positioned vertically between the second spring engagement point 66 and the suspension axis 54 in the lowered position. More specifically, a vertical distance between the suspension axis 54 and drive wheel axis 56 is approximately 40% of the vertical distance between the suspension axis 54 and the second spring engagement point 66 when the linking member 44 adopts the lowered position.

FIG. 8 further shows that the suspension axis 54 is positioned slightly above and vertically between the second spring engagement point 66 and the drive wheel axis 56 in the raised position. More specifically, the vertical distance between the drive wheel axis 56 and the suspension axis 54 is approximately 10% of the vertical distance between the drive wheel axis 56 and the second spring engagement point 66.

FIG. 7 further shows that the suspension axis 54 and the second spring engagement point 66 are horizontally aligned in the lowered position such that no torque is generated about the suspension axis 54 by the second spring member 48 when the linking member 44 is in the lowered position. In other words, the moment arm 70 of the force 62 from the second spring member 48 acting downwardly on the linking member 44, as illustrated in raised position of FIG. 8, is zero, or substantially zero, in the lowered position of FIG. 7.

FIG. 8 further shows that the second spring engagement point 66 is positioned horizontally between the suspension axis 54 and the drive wheel axis 56 in the raised position of the linking member 44. More specifically, the horizontal distance between the suspension axis 54 and the second spring engagement point 66 is approximately 30% of the horizontal distance between the suspension axis 54 and the drive wheel axis 56.

FIG. 7 further shows that the drive wheel axis 56 is positioned vertically between the first spring engagement point 50 and the suspension axis 54 in the lowered position. More specifically, the vertical distance between the suspension axis 54 and the drive wheel axis 56 is approximately 40% of the vertical distance between the suspension axis 54 and the first spring engagement point 50.

FIG. 8 further shows that the suspension axis 54 is positioned vertically between the first spring engagement point 50 and the drive wheel axis 56 in the raised position. More specifically, the vertical distance between the drive wheel axis 56 and the suspension axis 54 is approximately 10% of the vertical distance between the drive wheel axis 56 and the first spring engagement point 50.

FIG. 7 further shows that the suspension axis 54 and the first spring engagement point 50 are substantially horizontally aligned in the lowered position. FIG. 8 further shows that the first spring engagement point 50 is positioned horizontally between the suspension axis 54 and the drive wheel axis 56 in the raised position. More specifically, the horizontal distance between the suspension axis 54 and the first spring engagement point 50 is approximately 50% of the horizontal distance between the suspension axis 54 and the drive wheel axis 56 in the raised position.

The second spring member 48 thus ensures that the drive wheel 12 is pressed downwards against the ground surface 14, with a sufficient force to prevent slippage, also in the raised position where the force generated by the first spring member 46 is reduced. Due to the stronger contact between the drive wheel 12 and the ground surface 14, any navigation by the robotic cleaning device 10 based entirely or partly on odometry is improved. The robotic cleaning device 10 is thus less likely to lose track of its position.

The increased downward force on the drive wheel 12 in the raised position also gives a stronger force to a suction nozzle in the raised position and the robotic cleaning device is thereby less prone to stick to, for example, a carpet.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. A robotic cleaning device comprising:

a main body;

at least one drive wheel for driving the robotic cleaning device on a horizontal ground surface;

at least one linking member rotationally coupled to the main body about a suspension axis and rotationally supporting the at least one drive wheel about a drive wheel axis such that by rotating the linking member about the suspension axis in a first direction, at least a section of the main body can be raised from a lowered position, closer to the ground surface, to a raised position, further away from the ground surface; and a first spring member and a second spring member each arranged to provide a moment on the linking member about the suspension axis in the first direction to press the at least one drive wheel towards the ground surface;

wherein the moment provided by the first spring member is higher in the lowered position than in the raised position and the moment provided by the second spring member is higher in the raised position than in the lowered position.

2. The robotic cleaning device according to claim 1, wherein the first spring member comprises a tension spring.

3. The robotic cleaning device according to claim 1, wherein the second spring member comprises a cantilever spring biased against the linking member.

4. The robotic cleaning device according to claim 3, wherein the second spring member comprises a fixed section and a free section, wherein the fixed section is fixed with respect to the main body and the free section is biased against the linking member.

5. The robotic cleaning device according to claim 4, wherein the linking member comprises a cam profile engaged at a second spring engagement point by the free section of the second spring member.

6. The robotic cleaning device according to claim 5, wherein the drive wheel axis is positioned vertically between the second spring engagement point and the suspension axis in the lowered position and the suspension axis is positioned vertically between the second spring engagement point and the drive wheel axis in the raised position.

7. The robotic cleaning device according to claim 5, wherein the suspension axis and the second spring engagement point are substantially horizontally aligned in the lowered position and the second spring engagement point is positioned horizontally between the suspension axis and the drive wheel axis in the raised position.

8. The robotic cleaning device according to claim 3, wherein a moment arm of the free section of the second spring member biased against the linking member acting on the suspension axis is substantially zero when the main body is in the lowered position.

9. The robotic cleaning device according to claim 3, wherein the first spring member and the second spring member are substantially aligned in the lowered position and/or the raised position.

10. The robotic cleaning device according to claim 3, wherein the first spring member and the second spring member are substantially aligned with an upper edge of the linking member in the lowered position.

11. The robotic cleaning device according to claim 3, wherein the first spring member and the second spring member are oriented substantially parallel with the ground surface in the lowered position and/or the raised position.

12. The robotic cleaning device according to claim 1, wherein the first spring member is attached to the linking member at a first spring engagement point and wherein the drive wheel axis is positioned vertically between the first spring engagement point and the suspension axis in the lowered position and the suspension axis is positioned vertically between the first spring engagement point and the drive wheel axis the raised position.

13. The robotic cleaning device according to claim 1, wherein the first spring member is attached to the linking member at a first spring engagement point and wherein the suspension axis is positioned horizontally between the first spring engagement point and the drive wheel axis in the lowered position and the first spring engagement point is positioned horizontally between the suspension axis and the drive wheel axis in the raised position.

14. The robotic cleaning device according to claim 1, wherein the first spring member is attached to the linking member at a first spring engagement point and wherein the suspension axis and the first spring engagement point are substantially horizontally aligned in the lowered position and the first spring engagement point positioned horizontally between the suspension axis and the drive wheel axis in the raised position.

* * * * *